US010959296B2

(12) United States Patent
Yun

(10) Patent No.: US 10,959,296 B2
(45) Date of Patent: Mar. 23, 2021

(54) COOKING APPARATUS AND CONTROL METHOD THEREOF

(71) Applicant: Samsung Electronics Co., Ltd, Suwon-si (KR)

(72) Inventor: Chang Sun Yun, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 369 days.

(21) Appl. No.: 15/900,576

(22) Filed: Feb. 20, 2018

(65) Prior Publication Data

US 2018/0242406 A1 Aug. 23, 2018

(30) Foreign Application Priority Data

Feb. 20, 2017 (KR) ..... 10-2017-0022299

(51) Int. Cl.
*H05B 6/12* (2006.01)
*H05B 6/06* (2006.01)

(52) U.S. Cl.
CPC ..... *H05B 6/1236* (2013.01); *H05B 6/062* (2013.01); *H05B 6/065* (2013.01); *H05B 2213/05* (2013.01)

(58) Field of Classification Search
CPC ..... H05B 6/1236; H05B 6/062; H05B 6/065; H05B 2213/05
USPC .. 219/626, 447.1, 448.12, 448.13, 518, 620, 219/665, 660, 675, 676
See application file for complete search history.

(56) References Cited

U.S. PATENT DOCUMENTS

| | | | | |
|---|---|---|---|---|
| 5,296,684 | A * | 3/1994 | Essig | H05B 3/746 219/447.1 |
| 8,492,684 | B2 | 7/2013 | Gutierrez et al. | |
| 8,791,399 | B2 * | 7/2014 | Nagamitsu | H05B 6/062 219/622 |
| 9,055,615 | B2 * | 6/2015 | Watanabe | H05B 6/062 |
| 9,144,115 | B2 * | 9/2015 | Usui | H05B 6/062 |
| 9,173,252 | B2 * | 10/2015 | Lee | H05B 6/062 |
| 9,307,580 | B2 * | 4/2016 | Lee | H05B 6/062 |
| 9,900,934 | B2 * | 2/2018 | Brasseur | H05B 6/062 |
| 10,605,464 | B2 * | 3/2020 | Altamura | F24C 15/107 |
| 2005/0029245 | A1 | 2/2005 | Gerola et al. | |

(Continued)

FOREIGN PATENT DOCUMENTS

| | | | |
|---|---|---|---|
| DE | 202007013494 | U1 | 12/2007 |
| EP | 2597929 | A1 | 5/2013 |

(Continued)

OTHER PUBLICATIONS

International Search Report regarding Application No. PCT/KR2018/001994, dated Jun. 8, 2018, 3 pages.

(Continued)

*Primary Examiner* — Lien M Ngo

(57) ABSTRACT

A cooking apparatus is disclosed. The cooking apparatus includes a capacitance detector and a cookware detection controller. The capacitance detector is configured to detect capacitance using two or more electrodes arranged on one side of each of a plurality of induction heating coils. The cookware detection controller is configured to identify an induction heating coil corresponding to a position where cookware is placed among the plurality of induction heating coils when it is determined that the cookware is placed on a cooking plate based on the capacitance.

16 Claims, 27 Drawing Sheets

(56) References Cited

U.S. PATENT DOCUMENTS

| | | | | |
|---|---|---|---|---|
| 2008/0173632 | A1* | 7/2008 | Jang | H05B 3/746 219/432 |
| 2010/0096385 | A1 | 4/2010 | Gutierrez et al. | |
| 2012/0024840 | A1* | 2/2012 | Lee | H05B 6/062 219/622 |
| 2016/0037585 | A1 | 2/2016 | Christiansen et al. | |

FOREIGN PATENT DOCUMENTS

| | | | |
|---|---|---|---|
| EP | 2914061 | A1 | 9/2015 |
| JP | 2008159494 | A | 7/2008 |
| JP | 2010097960 | A | 4/2010 |
| JP | 2011249198 | A | 12/2011 |
| KR | 10-2008-0068775 | A | 7/2008 |
| KR | 10-1465890 | B1 | 11/2014 |

OTHER PUBLICATIONS

Extended European Search Report regarding Application No. 18156508.6, dated Jul. 5, 2018, 8 pages.

Communication pursuant to Article 94(3) EPC dated Apr. 30, 2020 in connection with European Patent Application No. 18 156 508.6, 4 pages.

* cited by examiner

COOKING APPARATUS AND CONTROL METHOD THEREOF

CROSS-REFERENCE TO RELATED APPLICATION

This application is related to and claims the benefit of Korean Patent Application No. 10-2017-0022299 filed on Feb. 20, 2017, the contents of which are incorporated herein by reference.

TECHNICAL FIELD

The present disclosure relates to a cooking apparatus equipped with a plurality of induction heating coils.

BACKGROUND

An induction heating cooker is a cooking apparatus that cooks the food based on the induction heating principle. The induction heating cooker includes a cooking plate to put the cookware thereon and an induction coil that produces a magnetic field when a current is applied thereto.

When a current is applied to the induction coil and a magnetic field is produced, a secondary current is induced in the cookware and Joule heat is produced by the resistance of the cookware itself. Accordingly, the cookware is heated and the food contained in the cookware is cooked.

The induction heating cooker has some advantages in that it enables quick heating, produces no harmful gas, and has little risk of catching fire as compared with a gas range or a kerosene furnace that burns fossil fuels like gas or oil to heat the cookware by the combustion heat. Accordingly, various studies are being conducted to increase usability of the induction heating cooker.

SUMMARY

The present disclosure provides a cooking apparatus that determines whether the cookware is placed on the cooking plate by detecting capacitance.

The present disclosure also provides a cooking apparatus that identifies at least one induction heating coil corresponding to a position of the cookware when it is determined that the cookware is placed on the coo-top.

In accordance with one aspect of the present disclosure a cooking apparatus comprise a capacitance detector detecting capacitance using two or more electrodes arranged on one side of each of a plurality of induction heating coils and a cookware detection controller configured to identify an induction heating coil corresponding to a position of cookware among the plurality of induction heating coils when it is determined that the cookware is placed on a cooking plate based on the capacitance.

The each of the plurality of induction heating coils may include a first electrode and a second electrode implemented in a form of at least one symbol, polygon, letter, and number on one side and the capacitance detector may detect capacitance from a potential difference between the first electrode and the second electrode.

A ratio between a total area of the two or more electrodes and an area of an induction heating coil with the two or more electrodes arranged on one side may be predeteminded.

The two or more electrodes may be inserted and fixed between the plurality of induction heating coils and the cooking plate, or attached onto a base that receives at least one of the plurality of induction heating coils by an adhesive material durable under at least a predetermined temperature.

The each of the plurality of induction heating coils may include an insulation sheet provided on one side and the two or more electrodes are attached onto one face of the insulation sheet by an adhesive material.

The capacitance detector may detect capacitance using two or more electrodes arranged on top of each of the plurality of induction heating coils.

The cookware detection controller may determine whether to perform a re-determination process that re-determines whether the cookware is placed on the cooking plate, based on whether a value of the capacitance exceeds a preset first threshold and a preset second threshold.

The cookware detection controller may perform a re-determination process that controls a driving current to be applied to at least one of the plurality of induction heating coils, when a value of the capacitance exceeds a preset first threshold and is less than a preset second threshold.

The cookware detection controller may control a driving current to be applied to at least one induction heating coil with electrodes arranged on one side, from which the value of the capacitance is derived and perform a re-determination process that re-determines whether the cookware is placed on the cooking plate based on at least one of a magnitude and a phase of a current in the at least one induction heating coil to which the driving current is applied when a value of the capacitance exceeds a preset first threshold and is less than a preset second threshold.

The cookware detection controller may re-detect capacitance and perform a re-determination process when a value of the capacitance exceeds a preset first threshold and is less than a preset second threshold.

The cookware detection controller may identify an induction heating coil corresponding to a position where the cookware is placed and display information about at least one of the identified induction heating coil and the position where the cookware is placed on a display when a value of the capacitance exceeds both a preset first threshold and a preset second threshold, The electrodes arranged on a side of each of the plurality of induction heating coils may be individually connected to an electrode connection terminal that supports connection with the capacitance detector or grouped to be connected to the electrode terminal.

In accordance with another aspect of the present disclosure a cooking apparatus comprise a cookware detection assembly configured to detect capacitance two or more electrodes arranged on one side of each of a plurality of induction heating coils, and identify at least one induction heating coil corresponding to a position of cookware among the plurality of induction heating coils when it is determined that the cookware is placed on a cooking plate based on the capacitance; and a main assembly configured to control components in the cooking apparatus based on data about a position where the cookware is placed and data about the at least one identified induction heating coil received from the cookware detection assembly.

The main assembly may control a position where the cookware is placed to be displayed on a display.

The each of the plurality of induction heating coils may include a first electrode and a second electrode arranged on one side and the cookware detection assembly may detect capacitance from a potential difference between the first electrode and the second electrode.

A ratio between a total area of the two or more electrodes and an area of an induction heating coil with the two or more electrodes arranged on one side may be predetermined.

The cookware detection assembly may determine whether to perform a re-determination process that re-determines whether the cookware is placed on the cooking plate, based on whether a value of the capacitance exceeds a preset first threshold and a preset second threshold.

The cookware detection assembly may control a driving current to be applied to at least one induction heating coil with electrodes arranged on one side, from which the value of the capacitance is derived, and perform a re-determination process that re-determines whether the cookware is placed on the cooking plate based on at least one of a magnitude and a phase of a current in the at least one induction heating coil to which the driving current is applied when a value of the capacitance exceeds a preset first threshold and is less than a preset second threshold, The cookware detection assembly may control switching devices in a predetermined switching sequence based on a form that the two or more electrodes are grouped, to sequentially detect capacitance when the two or more electrodes are grouped to be connected to an electrode connection terminal, The cookware detection assembly may identify an induction heating coil corresponding to a position where the cookware is placed and wherein the main assembly is configured to display information about at least one of the identified induction heating coil and the position where the cookware is placed on a display when a value of the capacitance exceeds both a preset first threshold and a preset second threshold.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 27, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

A cooking apparatus, as will be described below, refers to an appliance for cooking the food by heating based on the principle of induction heating, which includes a cooking plate to place the cookware thereon, and an induction heating coil to produce a magnetic field when a current is applied thereto.

Figure 1:
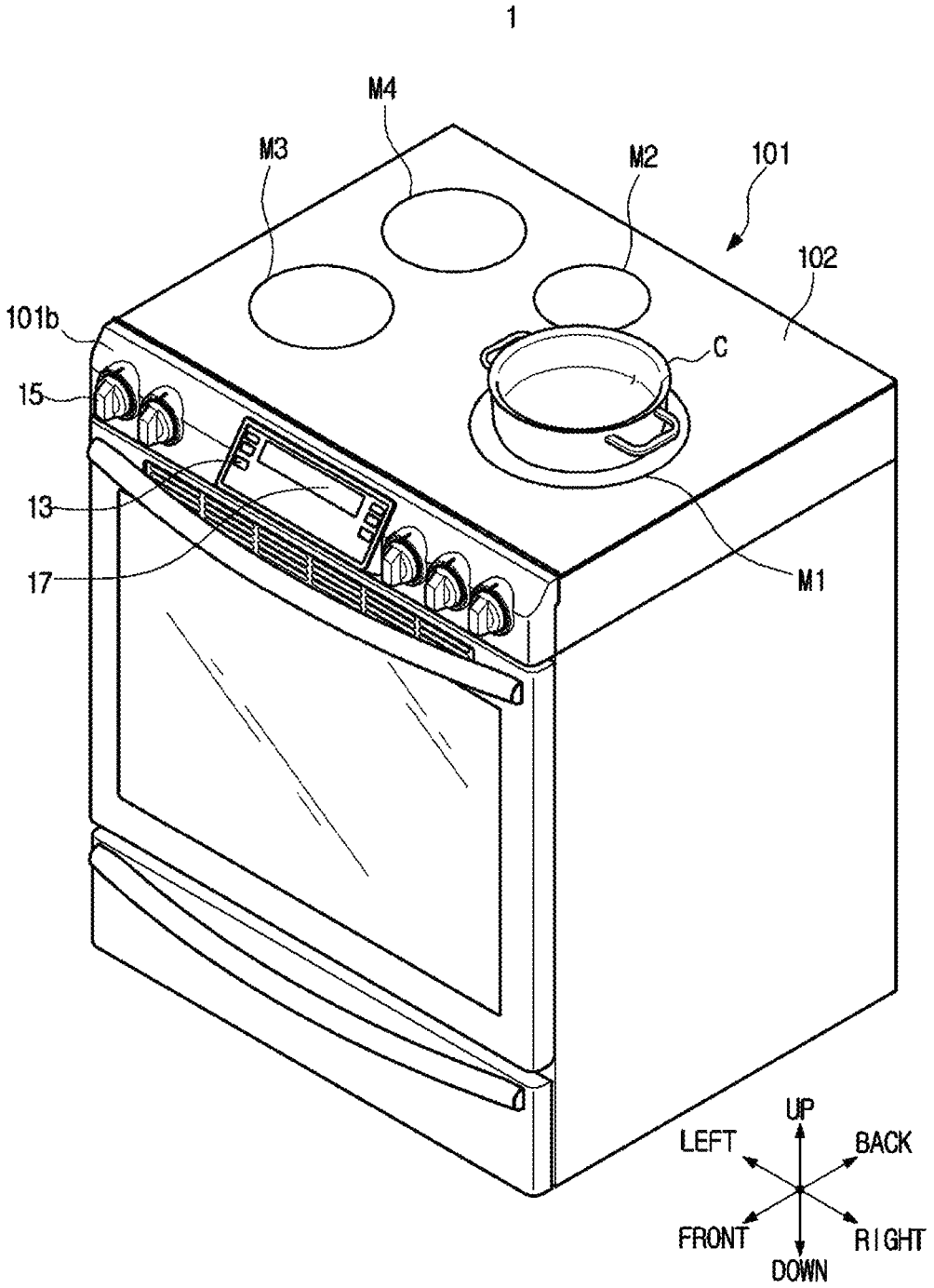
FIG. 1 schematically illustrates the exterior of a cooking apparatus, according to an embodiment of the present disclosure.
Figure 2:
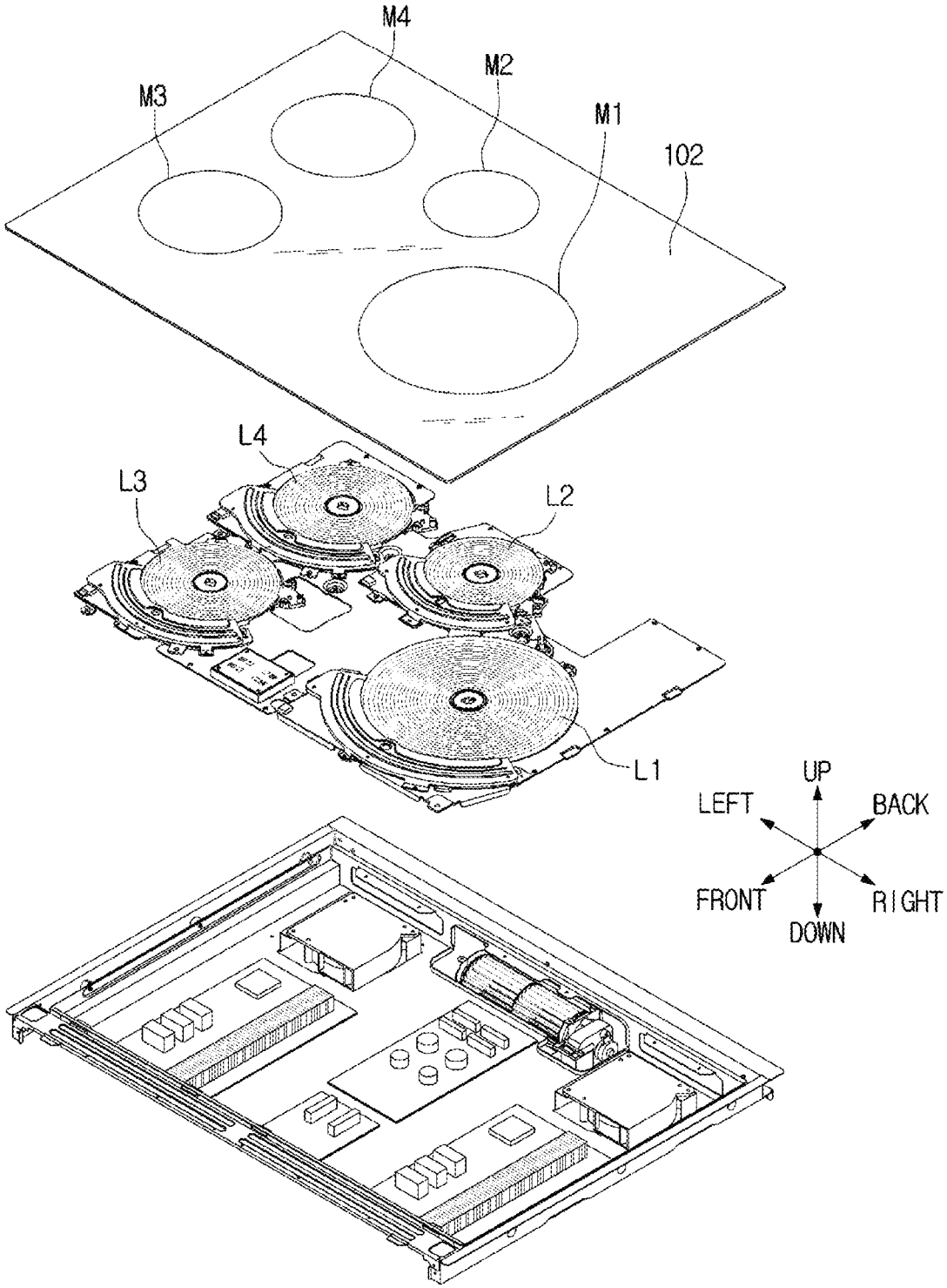
FIG. 2 schematically illustrates the interior of a cooking apparatus, according to an embodiment of the present disclosure.

FIG. 1 schematically illustrates the exterior of a cooking apparatus, according to an embodiment of the present disclosure, and FIG. 2 schematically illustrates the interior of a cooking apparatus, according to an embodiment of the present disclosure. The figures will now be described together to avoid overlapping explanation.

Referring to FIGS. 1 and 2, a cooking apparatus 1 includes a main body 101 forming the exterior of the cooking apparatus 1 and receiving various components constituting the cooking apparatus 1.

A cooking plate 102 may be provided on the top of the main body 101 to place the cookware C thereon. The cooking plate 102 may be implemented by tempered glass, such as ceramic glass to avoid being easily broken. It is not, however, limited thereto, but may be implemented by any known material.

Instructions may be marked on the top surface of the cooking plate 102 for the user to place the cookware on a proper location. For example, as shown in FIG. 1, a plurality of instruction marks M1, M2, M3, and M4 may be formed on the top surface of the cooking plate 102 to guide the user to a location for the cookware C.

At least one induction heating coil may be provided underneath the cooking plate 102 to produce a magnetic field. For example, there may be a plurality of induction heating coils L1, L2, L3, and L4 provided in the cooking apparatus 1, as shown in FIG. 2. The plurality of induction heating coils L1, L2, L3, and L4 may be located at positions corresponding to the instruction marks M1, M2, M3, and M4.

Furthermore, on the front side 101*b* of the main body 101, an operation dial 13, an operation button 15, and a display 17 may be provided to receive control commands from the user or display various information.

While the cooking apparatus 1 includes four induction heating coils L1, L2, L3, and L4 in the embodiment, it is not limited thereto, but may include at most three or at least five induction heating coils in some other embodiments.

Figure 3:
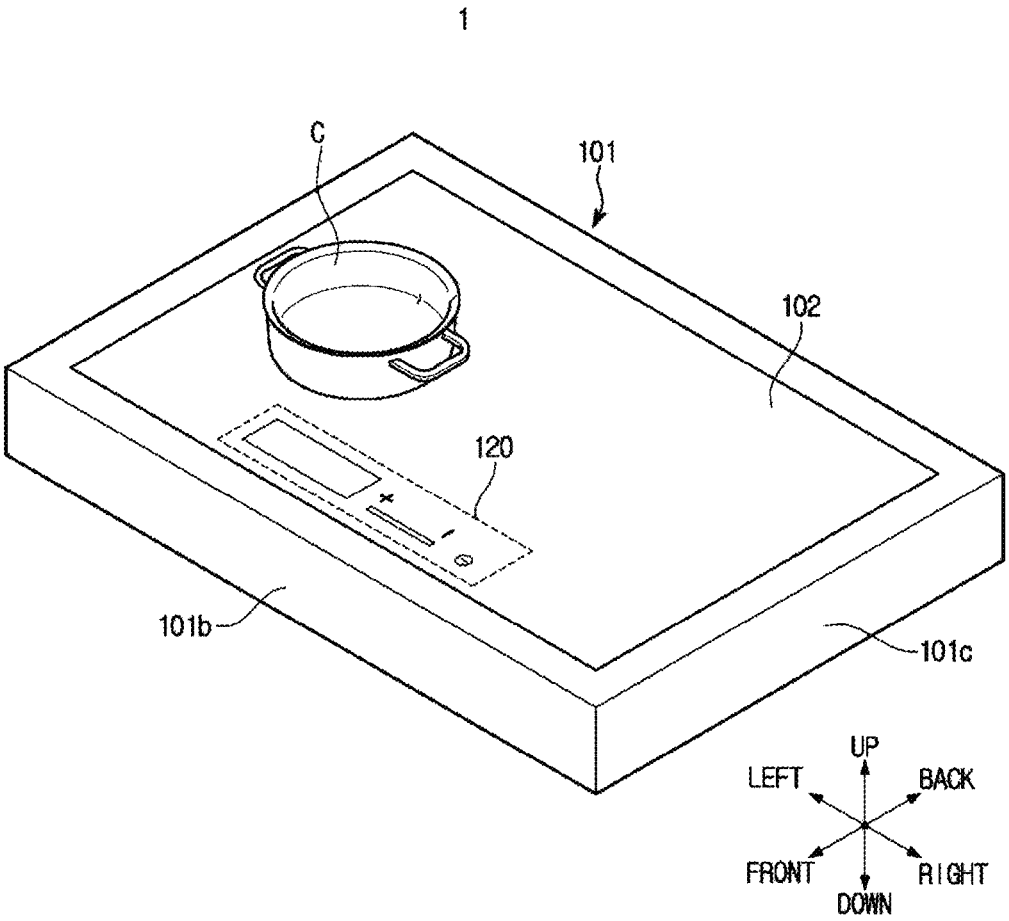
FIG. 3 schematically illustrates the exterior of a cooking apparatus, according to another embodiment of the present disclosure.
Figure 4:
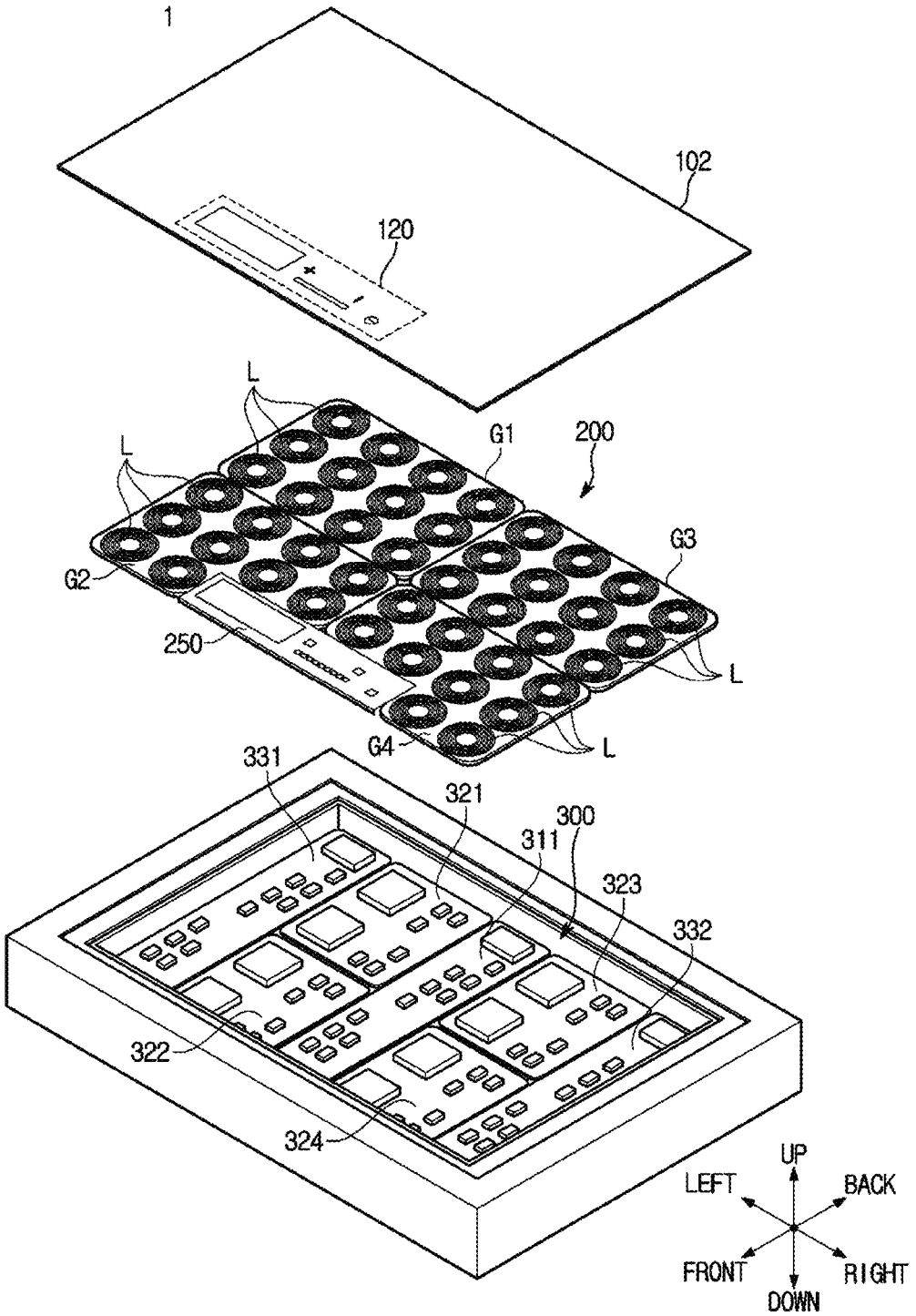
FIG. 4 schematically illustrates the interior of the cooking apparatus shown in FIG. 3.

For example, referring to FIGS. 3 and 4, the cooking apparatus 1 in accordance with another embodiment of the present disclosure may be implemented to include five or more induction heating coils L. The cooking apparatus implemented in the form as shown in FIG. 3 will now be focused as an example, without being limited thereto. It should be understood that any known form may be employed by the cooking apparatus that may use the induction heating coil to produce a magnetic field to heat the cookware.

Figure 5:
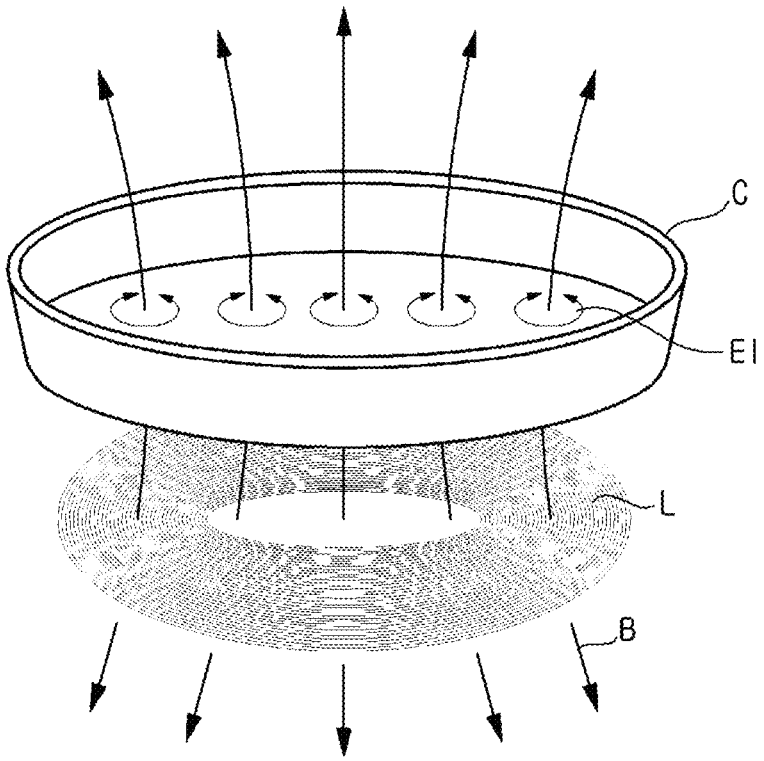
FIG. 5 illustrates a cooking apparatus for heating the cookware, according to an embodiment of the present disclosure.

FIG. 3 schematically illustrates the exterior of a cooking apparatus, according to another embodiment of the present disclosure, FIG. 4 schematically illustrates the interior of the cooking apparatus shown in FIG. 3, and FIG. 5 illustrates a cooking apparatus for heating the cookware, according to an embodiment of the present disclosure. The figures will now be described together to avoid overlapping explanation.

Referring to FIGS. 3 and 4, the cooking apparatus 1 may include the main body 101 forming the exterior of the cooking apparatus 1 having various parts therein to constitute the cooking apparatus 1.

The cooking plate 102 in the form of a flat plate may be provided on the top of the main body 101 to place the cookware C thereon. To avoid being easily broken, the cooking plate 102 may be made of tempered glass, such as ceramic glass.

The cookware C may be placed anywhere on the cooking plate 102. For example, for efficient operation of the cooking apparatus 1, a position of the cookware C on the cooking plate 102 may be detected, and an induction heating coil L corresponding to the position of the cookware C may be selectively activated. In this regard, when a position of the cookware C on the cooking plate 102 is accurately detected, an induction heating coil L required to be activated, i.e., an induction heating coil L that is located underneath where the cookware C is placed, may be accurately determined. In addition, when an object, which is not the cookware C, is placed on the cooking plate 102 and even detected as the cookware C, causing the induction heating coil L to be activated, there is a risk of not only damaging the cooking apparatus 1 or the object but also catching fire.

In the embodiment, the cooking apparatus 1 may accurately determine whether an object placed on the cooking plate 102 is the cookware C based on a capacitance value detected through electrodes, and correctly determine the position of the cookware C on the cooking plate 102, thereby giving safety and reliability to the user. How to determine whether the object placed on the cooking plate 102 is the cookware C and how to determine the position of the cookware C placed on the cooking plate 102 will be described later.

Meanwhile, on one side of the cooking plate 102, a user interface 120 may be provided to receive control commands from the user and display operation information of the cooking apparatus 1 for the user. The position of the user interface 120 is not, however, limited to the top surface of the cooking plate 102, but may be any position on the front 101*b* and/or side 101*c* of the main body 101.

As shown in FIG. 4, there may be a heating layer 200 including a plurality of induction heating coils L for heating the cookware C and a main assembly 250 for implementing the user interface 120 provided underneath the cooking plate 102.

Each of the plurality of induction heating coils L may produce a magnetic field and/or electromagnetic field for heating the cookware C. When a driving current is applied to the induction heating coil L, a magnetic field B may be induced around the induction heating coil L, as shown in FIG. 5. Especially, when a current that alternates in magnitude and direction over time, i.e., an alternate current (AC) is applied to the induction heating coil L, a magnetic field B changing in magnitude and direction over time may be induced around the induction heating coil L.

The magnetic field B around the induction heating coil L may pass the cooking plate 102 made of tempered glass and reach the cookware C placed on the cooking plate 102.

Due to the magnetic field B changing in magnitude and direction over time, eddy currents EI circulating around the magnetic field B may be induced in the cookware C. As such, a phenomenon in which a time-varying magnetic field induces eddy currents is called a law of electromagnetic induction. Electrical resistance heat may be generated in the cookware C due to the eddy currents EI. The electrical resistance heat is heat generated in a resistor when a current flows in the resistor, also called Joule Heat. The cookware C may be heated by the electrical resistance heat, and the food contained in the cookware C may also be heated. Accordingly, the cooking apparatus 1 in accordance with an embodiment of the present disclosure may apply a current to the plurality of induction heating coils L and heat the cookware C by means of the magnetic field B induced by the plurality of induction heating coil L. Each of the plurality of induction heating coils L may heat the cookware C by the law of electromagnetic induction and the electrical resistance heat.

The plurality of induction heating coils L may be arranged underneath the cooking plate 102 in a predetermined pattern. For example, as shown in FIG. 4, the plurality of induction heating coils L may be arranged in columns and rows like a matrix. In other words, the plurality of induction heating coils L may be arranged from front to back and left to right of the main body 101 at certain intervals.

In the meantime, at least two or more electrodes may be arranged on a side of each of the plurality of induction heating coils L. For example, at least two or more electrodes may be arranged in the space between the plurality of induction heating coils L and the cooking plate 102, and in an embodiment, the cooking apparatus 1 may identify the cookware C based on capacitance between the at least two or more electrodes and determine a position where the cookware C is placed.

In the following description, for convenience of explanation, an occasion when two electrodes are arranged on a side of each induction heating coil L will be focused, but there is no limitation on the number of the electrodes. For example, there may be three or more electrodes may be arranged on the side of each induction heating coil L. In the following description, the two electrodes arranged on one side of each induction heating coil L will be called first and second electrodes, which will be collectively called an electrode pair.

The plurality of induction heating coils L may be grouped into one or more coil groups, and as will be described later, electric pairs arranged on top of the plurality of induction heating coils L may also be grouped into one or more electrode groups. The electrode groups may correspond to the coil groups, and each electrode group may be connected to a connection terminal for detection of capacitance.

The plurality of induction heating coils L may be divided into multiple groups G1, G2, G3, and G4. For example, as shown in FIG. 4, first to forty-fourth induction heating coils L may be divided into a first coil group G1, a second coil group G2, a third coil group G3, and a fourth coil group G4. The first coil group G1 may include the first to eleventh induction heating coils, the second coil group G2 may include the twelfth to twenty-second induction heating coils, the third coil group G3 may include the twenty-third to thirty third induction heating coils, and the fourth coil group G4 may include the thirty-fourth to forty-fourth induction heating coils.

The first electrode group may include electrode pairs arranged on top of the first to eleventh induction heating coils, the second electrode group may include electrode pairs arranged on top of the twelfth to twenty-second induction heating coils, the third electrode group may include electrode pairs arranged on top of the twenty-third to thirty third induction heating coils, and the fourth electrode group may include electrode pairs arranged on top of the thirty-fourth to forty-fourth induction heating coils.

In this regard, as will be described later, a capacitance detector may be connected to individual electrode pairs arranged on top of the plurality of induction heating coils L through connection terminals to detect capacitance through the electrode pair.

Alternatively, the capacitance detector may be connected to each of the electrode groups through a connection terminal. For example, the capacitance detector may be connected to 11 electrode pairs belonging to the first electrode group through a connection terminal. The 11 electrode pairs may each be connected to switching devices and may be connected in parallel to one another, and the capacitance detector may control on/off of the switching devices to sequentially detect the capacitance across each of electrode pairs belonging to each electrode group. This will be described in more detail later.

The form of arrangement of the plurality of induction heat coils L is not limited to what is shown in FIG. 4, and the plurality of induction heating coils L may be arranged in various forms. For example, the plurality of induction heating coils L may be arranged in the form of a hive to minimize the gap between the induction heating coils L.

The position of a main assembly 250 is not limited to what is shown in FIG. 4, but may be anywhere. For example, in a case that the user interface 120 is installed on the front 101*b* of the main body 101, the main assembly 250 may be located behind the front 101*b* separately from the heating layer 200.

A driving layer 300 including a plurality of printed circuit board (PCB) assemblies 311, 321, 322, 323, 324, 331, and 332 equipped with circuits to apply driving currents to the plurality of induction heating coils L or circuits to detect capacitance between electrodes may be arranged under the heating layer 200.

The driving layer 300 may be partitioned into the plurality of PCB assemblies 311, 321, 322, 323, 324, 331, and 332, as shown in FIG. 4, and at least one of the plurality of PCB assemblies 311, 321, 322, 323, 324, 331, and 332 may include switching devices, integrated circuit (IC) devices, and a PCB having the devices mounted thereon. At least one of the plurality of PCB assemblies 311, 321, 322, 323, 324, 331, and 332 may include devices to detect capacitance and a PCB having the devices mounted thereon.

For example, the plurality of PCB assemblies 311, 321, 322, 323, 324, 331, and 332 may include a cookware detection assembly 311 having a capacitance detection circuit installed therein to determine whether the cookware C is placed above one of the plurality of induction heating coils L and determine a position of the cookware C, driving assemblies 321, 322, 323, and 324 having driving circuits installed therein to apply driving currents to the plurality of induction heating coils L, and power assemblies 331 and 332 having power circuits installed therein to supply power to the driving circuits.

As such, with the detection circuit, the driving circuit and the power circuit installed in separate PCB assemblies, assemblability may be improved in a manufacturing process of the cooking apparatus 1. In other words, in comparison with the detection circuit, the driving circuit and the power circuit installed in a single PCB assembly, installing the detection circuit, the driving circuit and the power circuit in the cookware detection assembly 311, the driving assemblies 321, 322, 323, and 324, and the power assemblies 331 and 332, respectively, makes it easy to manufacture the PCB assemblies. Furthermore, it is easy to assemble several PCB assemblies in small sizes into the main body as compared with assembling a large size of PCB assembly into the main body.

With the detection circuit, the driving circuit and the power circuit installed in separate PCB assemblies, it is easy to manage and maintain the cooking apparatus 1. For example, even when a malfunction occurs in one of the PCB assemblies, the malfunctioning PCB assembly may be selectively replaced.

Furthermore, with the detection circuit, the driving circuit and the power circuit installed in separate PCB assemblies, interference among the circuits may be reduced. For example, since the detection circuit is spatially separated from the power circuit that supplies AC power, influence of noise of the power circuit to the detection circuit may be noticeably reduced.

As the number of induction heating coils L included in the cooking apparatus 1 increases, it is less efficient to use a single driving circuit to apply driving currents to all the induction heating coils L. Accordingly, the cooking apparatus 1 in accordance with an embodiment of the present disclosure may include a plurality of driving circuits, which may be installed in the plurality of driving assemblies 321, 322, 323, and 324. For example, four driving circuits may be installed in the four driving assemblies 321, 322, 323, and 324.

The four driving assemblies 321, 322, 323, and 324 may apply driving currents to induction heating coils L included in the first to fourth coil groups L1, L2, L3, and L4, respectively. For example, the first driving assembly 321 may apply a driving current to induction heating coils L belonging to the first coil group G1 and the second driving assembly 322 may apply a driving current to induction heating coils L belonging to the second coil group G2. The third driving assembly 323 may apply a driving current to induction heating coils L belonging to the third coil group G3 and the fourth driving assembly 324 may apply a driving current to induction heating coils L belonging to the fourth coil group G4.

The number of the driving assemblies and the number of the groups are not limited to what is shown in FIG. 4, but may vary by the number of induction heating coils L, the size of the cooking apparatus 1, the size of devices constituting the driving circuit, the magnitude of a driving current applied to each of the induction heating coil L, and the magnitude of a current that each driving assembly may output.

For example, when the size of the cooking apparatus 1 is reduced and the number of the induction heating coils L decreases, the driving circuit may be installed in each of two driving assemblies. On the other hand, when the size of the cooking apparatus 1 becomes bigger, and the number of the induction heating coils L increases, the driving circuit may be installed in each of six or eight driving assemblies.

Four driving assemblies 321, 322, 323, and 324 may be arranged on both sides from the cookware detection assembly 311, two on either side. For example, the first and second driving assemblies 321 and 322 may be arranged on the left from the cookware detection assembly 311, and the third and fourth driving assembles 323 and 324 may be arranged on the right from the cookware detection assembly 311.

Since the four driving assemblies 321, 322, 323, and 324 are arranged on both sides from the cookware detection assembly 311, two on either side, the power circuits may be installed in the two power assemblies 331, 332. In other words, two power assemblies 331 and 332 may be arranged on both sides of the driving assemblies 321 and 322, and 323 and 324 to supply AC power to the driving assemblies on either side 321 and 322, and 323 and 324 from the container detection assembly 311. For example, there may be the first power assembly 331 on the side of the first and second driving assemblies 321 and 322, and there may be the second power assembly 332 on the side of the third and fourth driving assemblies 323 and 324.

The cooking apparatus 1 may include the plurality of induction heating coils L to heat the cookware C, and detection circuit, driving circuit, and power circuit to apply the driving current to the induction heating coil L. The components required to operate the cooking apparatus 1, e.g., the detection circuit, the driving circuit, and the power circuit, may be installed in a plurality of PCB assemblies 311, 321, 322, 323, 324, 331, and 332, which are separated from one another. As the components required to operate the cooking apparatus 1 are installed in the plurality of PCB assemblies 311, 321, 322, 323, 324, 331, and 332, it may become easier to manufacture and assemble the PCB assemblies 311, 321, 322, 323, 324, 331, and 332 and the productivity of the cooking apparatus 1 may be improved. Internal configurations of the cooking apparatus 1 will now be described in more detail.

Figure 6:
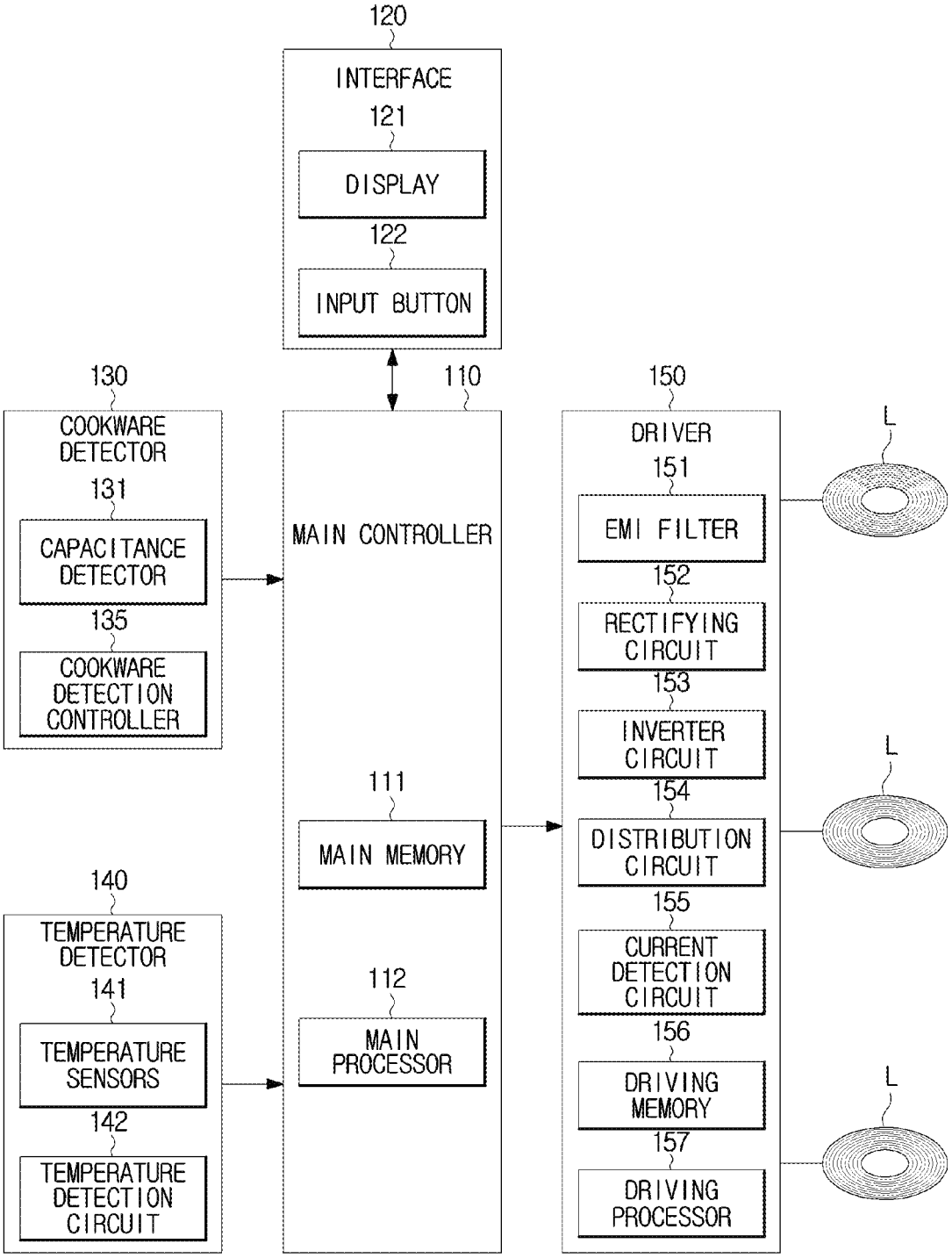
FIG. 6 illustrates a schematic control block diagram of a cooking apparatus, according to an embodiment of the present disclosure.
Figure 7:
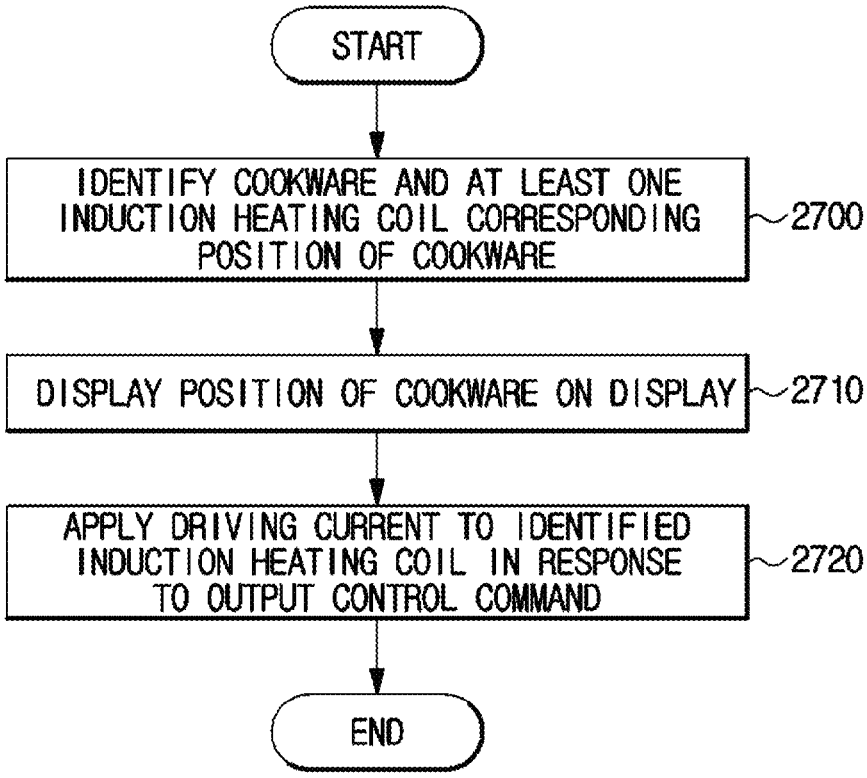
FIG. 7 schematically illustrates an induction heating coil and a temperature sensor included in a cooking apparatus, according to an embodiment of the present disclosure.
Figure 8:
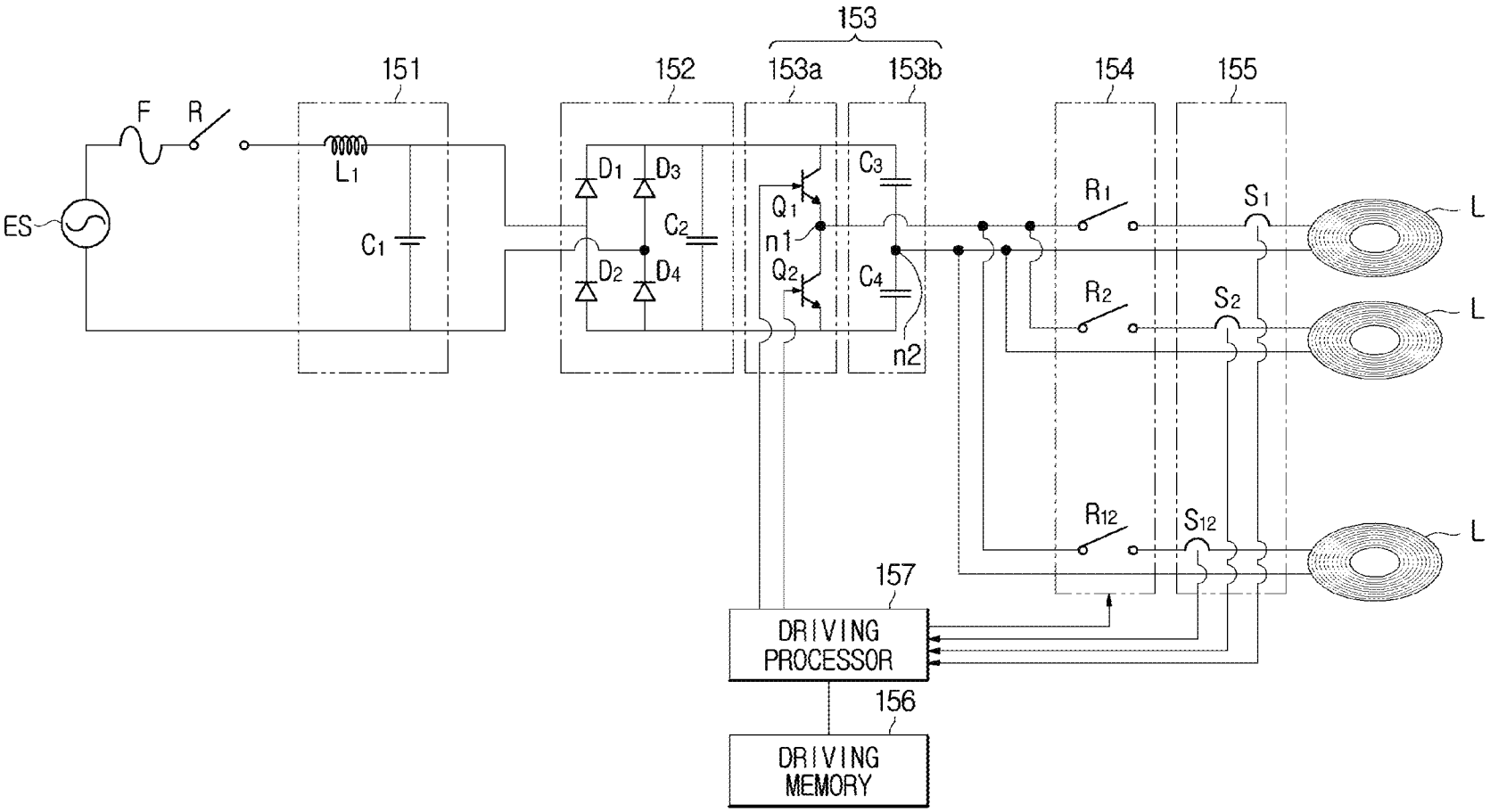
FIG. 8 illustrates a schematic circuit diagram of a driver included in a cooking apparatus, according to an embodiment of the present disclosure.
Figure 9:
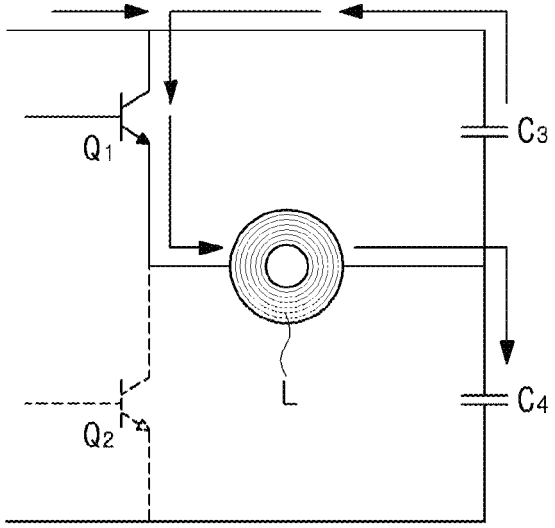
FIGS. 9 and 10 are diagrams for illustrating an operation of a driver and an induction heating coil included in a cooking apparatus, according to different embodiments of the present disclosure.
Figure 10:
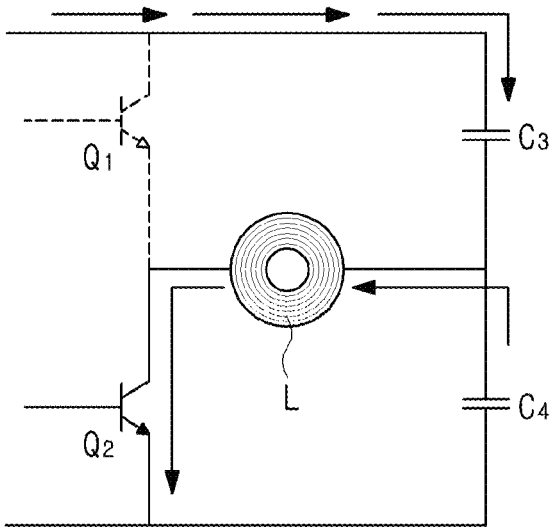

FIG. 6 illustrates a schematic control block diagram of a cooking apparatus, according to an embodiment of the present disclosure, and FIG. 7 schematically illustrates an induction heating coil and a temperature sensor included in a cooking apparatus, according to an embodiment of the present disclosure. FIG. 8 illustrates a schematic circuit diagram of a driver included in a cooking apparatus, according to an embodiment of the present disclosure, and FIGS. 9 and 10 are diagrams for illustrating an operation of a driver and an induction heating coil included in a cooking apparatus, according to different embodiments of the present disclosure. The figures will now be described together to avoid overlapping explanation.

Referring to FIG. 6, the cooking apparatus 1 may include a plurality of induction heating coils L, the user interface 120, a cookware detector 130, a temperature detector 140, a driver 150, and a main controller 110. The cookware detector 130, the temperature detector 140, the driver 150, and the main controller 110 may be operated by a processor or processors. The plurality of induction heating coils L were described above, so the details thereof will be omitted.

For example, the cookware detector 130, the temperature detector 140, the driver 150, and the main controller 110 may be separately implemented. In this regard, as described above, the driver 150 may be arranged in each of the driving assemblies 321, 322, 323, and 324, and the main controller 110 and the user interface 120 may be arranged in a main assembly, which will be described later. Furthermore, the cookware detector 130 may be arranged in the cookware detection assembly 311, and the temperature detector 140 may be arranged in one of the plurality of PCB assemblies 311, 321, 322, 323, 324, 331, and 332, without being limited thereto.

In another example, at least one of the cookware detector 130, the temperature detector 140, the driver 150, and the main controller 110 may be integrated in a system on chip (SoC) equipped in the cooking apparatus 1. It is not limited to being integrated in one SoC because the cooking apparatus 1 may have more than one SoCs.

For example, the aforementioned components in the cooking apparatus 1 may be arranged or integrated in the plurality of PCB assemblies 311, 321, 322, 323, 324, 331, 332, without being limited thereto. However, for convenience of explanation, an occasion when the components in the cooking apparatus 1 are arranged in the plurality of PCB assemblies 311, 321, 322, 323, 324, 331, 332 will be focused in the following description. The components in the cooking apparatus 1 will now be described individually.

The user interface 120 may include a display 121 for receiving touch inputs from the user or displaying various information about the cooking apparatus 1, and an input button 122 for receiving various control commands from the user.

The user interface 120 may receive a control command from the user and output an electric signal corresponding to the control command to the main controller 110. The user interface 120 may receive various information about the cooking apparatus 1 from the main controller 110 and display it.

The display 121 may receive a touch input from the user and forward it to the main controller 110. Furthermore, the display 121 may display various information about the cooking apparatus 1, e.g., operation state information of the cooking apparatus 1. The display 121 may employ a well-know touch screen type display panel, without being limited thereto.

For example, the display 121 may display an image representing a position of the cookware C detected by the cookware detector 130. The main controller 110 may send a control signal to the display 121 to control the display 121 to display the image representing the position of the cookware C detected by the cookware detector 130.

In another example, the display 121 may receive a touch input from the user that selects the cookware C and forward the touch input to the main controller 110. In an embodiment, upon reception of a command to increase output of the cooking apparatus 1 through the input button 122, the user interface 120 may output the command to increase output to the main controller 110. The main controller 110 will be described later in more detail.

The input button 122 may include a plurality of buttons to receive control commands from the user and output electric signals corresponding to the control commands from the user to the main controller 110. For example, the input button 122 may include a start button to receive a command to power on or off the cooking apparatus 1, a power up button and a power down button to receive commands to increase and decrease intensity of the magnetic field and/or the electromagnetic field produced by the cooking apparatus 1, respectively.

The input button 122 may employ various types of buttons or switches, which are known to the public, such as a push button, a slide button, a toggle button, a touch button, a dial, etc.

In the meantime, the cooking apparatus may be equipped with the temperature detector 140.

The temperature detector 140 may detect the temperature of the cookware C placed on the cooking plate 102. The cookware C may be heated by the induction heating coil L, and the heating level may be different depending on the material of the cookware C. Accordingly, the cooking apparatus 1 in accordance with an embodiment of the present disclosure may detect the temperature of the cookware C placed on the cooking plate 102 and deactivate the induction heating coil L when the cookware C is overheated, for safety.

For example, the temperature detector 140 may include a plurality of temperature sensors 141 to detect the temperature of the cookware C and a temperature detection circuit 142 to send output values of the plurality of temperature sensors 141 to the main controller 110.

The plurality of temperature sensors 141 are arranged around the plurality of induction heating coils L to measure the temperature of the cookware C heated by the induction heating coil(s). For example, the temperature sensor 141 may be located in the center of an induction heating coil L, as shown in FIG. 7, for directly measuring the temperature of the cookware C or measuring the temperature of the cooking plate 102, from which the temperature of the cookware C may be estimated. The position of the temperature sensor 141 is not limited to what is shown in FIG. 7, but may be any place around the induction heating coil L. Where to install the temperature sensor 141 will be described later.

The temperature sensor 141 may be implemented with various materials or devices capable of measuring temperature. For example, the first temperature sensor 141 may include a thermistor whose electric resistance is changed according to the temperature. The temperature sensor 141 may output a signal indicating the temperature of the cookware C or the cooking plate 102 to the temperature detection circuit 142.

The temperature detection circuit 142 may receive signals indicating the temperature of the cookware C from the plurality of temperature sensors 141 and determine the temperature of the cookware C from the received signals.

The temperature detection circuit 142 may include a multiplexer for sequentially receiving signals indicating the temperature from the plurality of temperature sensors 141, for example, 44 temperature sensors 141 when there are 44 induction heating coils L as shown in FIG. 4, and an analog-to-digital converter (ADC) for converting the signal indicating the temperature to digital temperature data.

The temperature detection circuit 142 may process the signals indicating the temperature of the cookware C output from the plurality of temperature sensors 141 and send the derived temperature data to the main controller 110. The main controller 110 may then determine whether the cookware C is overheated based on the detection result of the temperature detector 140, and stop heating the cookware C by controlling a current to be applied to the induction heating coil L when it is determined that the cookware C is overheated.

Referring to FIG. 6, the cooking apparatus 1 may include the driver 150.

The driver 150 may receive power from an external power source and supply a current to the induction heating coil L according to a driving control signal from the main controller 110. For example, the driver 150 may selectively apply the driving current to the plurality of induction heating coils L based on the output intensity output from the main controller 110.

As described above, the driving circuit may be installed in each of the plurality of driving assemblies 321, 322, 323, and 324. In the following description, for convenience of explanation, an occasion when the driving circuit is installed in one of the plurality of driving assemblies 321, 322, 323, and 324 will be focused.

The driver 150 may include an electromagnetic interference (EMI) filter 151, a rectifying circuit 152, an inverter circuit 153, a distribution circuit 154, a current detection circuit 155, a driving memory 156, and a driving processor 157, as shown in FIG. 6.

Referring to FIG. 8, the EMI filter 151 cuts off high-frequency noise included in the AC power (e.g., harmonics of AC power) supplied from an external power source (ES) while passing a predetermined frequency (e.g., 50 Hz or 60 Hz) of AC voltage and AC current.

The EMI filter 151 may include an inductor L1 arranged between an input and output terminals of the EMI filter 151 and a capacitor C1 arranged between a positive output terminal and a negative output terminal of the EMI filter 151. The inductor L1 may block passage of the high-frequency noise, and the capacitor C1 may bypass the high-frequency noise to the external power source ES.

Furthermore, there may be a fuse F and a relay R arranged between the EMI filter 151 and the external power source ES to cut off overcurrent.

The AC power with the high-frequency noise blocked by the EMI filter 151 may be supplied to the rectifying circuit 152. The rectifying circuit 152 may convert the AC power to direct current (DC) power. Specifically, the rectifying circuit 152 may convert AC voltage alternating in magnitude and polarity (alternating between positive voltage and negative voltage) over time to DC voltage having constant magnitude and polarity, and convert an AC current alternating in magnitude and direction (alternating between positive current and negative current) over time to a DC current having constant magnitude.

The rectifying circuit 152 may include a bridge diode. Specifically, the rectifying circuit 152 may include four diodes D1, D2, D3, and D4. The diodes D1, D2, D3, and D4 form diode pairs, each diode pair having two diodes connected in series to each other, and the two diode pairs may be connected in parallel to each other. The bridge diode may convert an AC voltage that changes in polarity over time to a positive DC voltage with constant polarity, and convert an AC current that changes in direction over time to a positive current with constant direction.

Furthermore, the rectifying circuit 152 may include a DC link capacitor C2. The DC link capacitor C2 may convert the positive voltage that changes magnitude over time to a DC voltage with the constant magnitude. That is, the rectifying circuit 152 may have an input of AC voltage and AC current from the EMI filter 151 and output a DC voltage and DC current.

Referring to FIG. 8, the inverter circuit 153 may include a switching circuit 153*a* to apply or cut off the driving current to the induction heating coil L, and a resonance circuit 153*b* to cause resonance with the induction heating coil L.

The switching circuit 153*a* may include a first switching device Q1 and a second switching device Q2, which may be connected in series to each other between a plus line P and a minus line N.

The first and second switching devices Q1 and Q2 may each be turned on or off according to a driving control signal from the driving processor 157. Depending on whether each of the first and second switching devices Q1 and Q2 is turned on or off, a current is output to the induction heating coil L through the first switching device Q1 and/or the second switching device Q2 or a current is input from the induction heating coil L through the first switching device Q1 and/or the second switching device Q2.

For example, as shown in FIG. 9, when the first switching device Q1 is closed (turned on) and the second switching device Q2 is opened (turned off), the current may be applied to the induction heating coil L through the first switching device Q1. Moreover, as shown in FIG. 10, when the first switching device Q1 is opened (turned off) and the second switching device Q2 is closed (turned on), the current may be applied from the induction heating coil L through the second switching device Q2.

Since the first switching device Q1 and the second switching device Q2 are turned on or off at high speed of 20 kilohertz (kHz) to 70 kHz, the first and second switching devices Q1 and Q2 may include fast respondent three-terminal semiconductor device switches. For example, the first and second switching devices Q1 and Q2 may each employ a bipolar junction transistor BJT, a metal-oxide-semiconductor field effect transistor (MOSFET), insulated gate bipolar transistor (IGBT), transistor, or the like.

The resonance circuit 153*b* may include a first resonant capacitance C3 and a second resonant capacitance C4, which may be connected in series to each other between a plus line P and a minus line N.

A current may be output from the first resonant capacitor C3 and/or the second resonant capacitor C4 to the induction heating coil L, or a current may be input from the induction heating coil L to the first resonant capacitor C3 and/or the second resonant capacitor C4.

For example, as shown in FIG. 9, when the first switching device Q1 is closed (turned on) and the second switching device Q2 is opened (turned off), the current may be applied from the induction heating coil L to the first resonant capacitor C3 and/or the second resonant capacitor C4. Moreover, as shown in FIG. 10, when the first switching device Q1 is opened (turned off) and the second switching device Q2 is closed (turned on), the current may be applied to the induction heating coil L from the first resonant capacitor C3 and/or the second resonant capacitor C4.

The inverter circuit 153 may control the current to be applied to the induction heating coil L. Specifically, depending on whether the first switching device Q1 and the second switching device Q2 included in the inverter circuit 153 is each turned on or off, a positive current or a negative current may be applied to the induction heating coil L.

For example, as shown in FIG. 9, when the first switching device Q1 is closed (turned on) and the second switching device Q2 is opened (turned off), the current applied from the rectifying circuit 152 may be applied to the induction heating coil L through the first switching device Q1. The current applied to the induction heating coil L is applied to the second resonant capacitor C4 through the induction heating coil L, and electric energy is stored in the second resonant capacitor C4. At this time, a positive current may flow in the induction heating coil L. As the electric energy is stored in the second resonant capacitor C4, the current may be applied to the induction heating coil L from the first resonant capacitor C3 through the first switching device Q1.

Moreover, as shown in FIG. 10, when the first switching device Q1 is opened (turned off) and the second switching device Q2 is closed (turned on), the current may be applied to the induction heating coil L from the second resonant capacitor C4. The current applied to the induction heating coil L may flow to the rectifying circuit 152 through the induction heating coil L and the second switching device Q2. At this time, a negative current may flow in the induction heating coil L. As the current is output from the second resonant capacitor C4, the electric energy stored in the second resonant capacitor C4 is reduced, and as the electric energy of the second resonant capacitor C4 is reduced, the current may be applied to the first resonant capacitor C3 from the rectifying circuit 152.

The distribution circuit 154 may include a plurality of switches R1, R2, . . . R12 to pass or block the current applied to the plurality of induction heating coils L, and the plurality of switches R1, R2, . . . , R12 may each be turned on or off according to distribution control signals from the driving processor 157.

As shown in FIG. 8, the induction heating coils L are connected in parallel with each other between a first node n1 at which the first switching device Q1 and the second switching device Q2 are connected and a second node n2 at which the first resonant capacitor C3 and the second resonant capacitor C4 are connected. The plurality of switches R1, R2, . . . , R12 of the distribution circuit 154 may be connected in series with the plurality of induction heating coils L, and may pass or block the current applied from the inverter circuit 153 to the induction heating coil L.

The driver 150 may apply the driving current to the plurality of induction heating coils L included in the first to fourth coil groups G1, G2, G3, and G4. At this time, the driver 150 may apply the driving current to all of the plurality of induction heating coils L, but for efficient operation, selectively apply the driving current to the induction heating coil L arranged in an area corresponding to a position where the cookware C is placed.

Specifically, when it is determined that the cookware C is placed on the cooking plate 102, the cooking apparatus 1 may close (turn on) the switches R1, R2, . . . , R12 connected to the induction heating coil L arranged underneath the cookware C, i.e., in the area corresponding to the position where the cookware C is placed on the cooking plate 102, open (turn off) the switches R1, R2, . . . , R12 connected to the other induction heating coil L arranged in an area that does not correspond to the cookware C, and control the inverter circuit 153 to apply the driving current to the plurality of induction heating coils L.

If the driver 150 drives 11 of the induction heating coils L, e.g., the first to eleventh induction heating coils belonging to the first coil group G1, there may be 11 switches R1, R2, . . . , R11 to control the current to be applied to each of the 11 induction heating coils L.

Each of the plurality of switches R1, R2, . . . , R12 included in the distribution circuit 154 may include a relay. As such, the distribution circuit 154 may block the driving current to the induction heating coil L that does not correspond to the cookware C but pass the driving current to the induction heating coil L that correspond to the cookware C.

The current detection circuit 155 may include current sensors S1, S2, . . . , S12 to measure the current applied to each of the induction heating coils L. The current sensors S1, S2, . . . , S12 may output an electric signal corresponding to a measured current to the driving processor 157.

To control an amount of heat created by the cookware C, the user may control output of the cooking apparatus 100 through the user interface 120. In this regard, an amount of heat created by the cookware C may be controlled based on the intensity of the magnetic field B produced by the induction heating coil L, and the intensity of the magnetic field B produced by the induction heating coil L may be controlled based on the magnitude of the current applied to the induction heating coil L. Accordingly, the cooking apparatus 1 may control the magnitude of the current to be applied to the induction heating coil L to control an amount of heat created by the cookware C, and may measure the current applied to the induction heating coil L to control the magnitude of the current to be applied to the induction heating coil L.

The current sensors S1, S2, . . . , S12 may measure the current of the induction heating coil L to control the magnitude of the current to be applied to the induction heating coil L.

The current sensors S1, S2, . . . , S12 may include various circuits. For example, the current sensors S1, S2, . . . , S12 may include hall sensors to measure the intensity of a magnetic field produced around an electric wire to apply the current to the induction heating coil L, and may calculate a value of the current applied to the induction heating coil L based on the intensity of the magnetic field measured by the hall sensor. In this way, the current detection circuit 155 may measure the magnitude of the current applied to each of the plurality of induction heating coils L.

The driving memory 156 may store a driving program and driving data for controlling the operation of the driver 150. Furthermore, the driving memory 156 may temporarily store control instructions received from the main controller 110 and current values measured by the current detection circuit 155.

Moreover, the driving memory 156 may provide the driving program and/or the driving data to the driving processor 157 according to a memory control signal from the driving processor 157, or provide control instructions received from the main controller 110 and/or current values measured by the current detection circuit 155 to the driving processor 157.

The driving memory 156 may include a volatile memory, such as a static random access memory (SRAM), a dynamic RAM (DRAM), or the like, which may temporarily store data. The driving memory 156 may also include a non-volatile memory, such as a Read Only Memory (ROM), an Erasable Programmable ROM (EPROM), an Electrically Erasable Programmable ROM (EEPROM), flash memory, or the like, which may permanently store the driving control program and/or driving control data.

The driving processor 157 may include various logic circuits and operation circuits, and process data under a program provided from the driving memory 156 and generate a control signal according to the result of the process.

For example, the driving processor 157 may calculate a switching frequency (turn-on/turn-off frequency) for the switching circuit 153*a* of the inverter circuit 153 from an output control signal indicating output intensity of the cooking apparatus 1 and a current value received from the current detection circuit 155, and generate a driving control signal to turn on/turn off the switching circuit 153*a* according to the calculated switching frequency. Furthermore, the driving processor 157 may generate distribution control signals to turn on or off the plurality of switches R1, R2, . . . , R12 of the distribution circuit 154 depending on the position information of the cookware C received from the controller 110.

The driving memory 156 and the driving processor 157 may be implemented in separate integrated circuits (ICs) or implemented integrally in a single IC.

The main controller 110 may be equipped in the cooking apparatus 1 for controlling overall operation of the cooking apparatus 1.

For example, the main controller 110 may control general operation of the cooking apparatus 100 under the control command input through the user interface 120, and include a main memory 111 and a main processor 112. The main processor 112 may generate control signals based on data stored in the main memory 111 and control the components of the cooking apparatus 1 based on the control signals.

The main memory 111 may store a control program and control data for controlling the operation of the cooking apparatus 1. Furthermore, the main memory 111 may temporarily store various control commands input through the user interface 120, position data of the cookware C received from the cookware detector 130, and temperature data of the cookware C received from the temperature detector 140.

The main memory 111 may also provide a control program/control data to the main processor 112 according to a control signal from the main processor 112 or provide input control commands, position data of the cookware C and/or temperature data of the cookware C to the main processor 112.

The main memory 111 may include volatile memories, such as S-RAMs, D-RAMS, or the like, to temporarily store data. Furthermore, the main memory 111 may include non-volatile memories, such as ROMs, EPROMs, EEPROMs, flash memories, etc., to permanently store the control program and/or control data.

The main processor 112 may include various logic circuits and operation circuits, and process data under a program provided from the main memory 111 and generate a control signal according to the result of the process.

For example, the main processor 112 may generate output control signals to control the intensity of a magnetic field B of the induction heating coil L according to the output intensity selected from the user interface 120. In another example, the main processor 112 may generate an anti-overheating signal to cut off the AC power supplied to the driver 150 depending on the temperature of the cookware C. In still another example, the main processor 112 may generate distribution control signals to turn on or off the plurality of switches R1, R2, . . . , R12 of the distribution circuit 154 depending on the position of the cookware C.

In yet another example, the main processor 112 may determine whether an error of the cooking apparatus 1 occurs. In an embodiment, the main processor 112 may receive a value of the driving current applied to the induction heating coil L detected by the current detection circuit 155. When the value of the driving current is beyond a normal range, the main processor 112 may determine that an error occurs and perform a process to take measures against the error. In addition, the main processor 112 may determine whether an error occurs during the operation of the cooking apparatus 1 based on various control signals or state information received from the components equipped in the cooking apparatus 1.

In another example, the main processor 112 may control the display 121 to display a result of determining a position of the cookware C derived from the cookware detector 130. The cookware detector 130 will be described later in more detail.

When an output control command is received through the user interface 120, the main processor 112 may generate an output control signal to control the intensity of a magnetic field B of the induction heating coil L corresponding to the area in which the cookware C is placed. In other words, the main processor 112 may increase energy efficiency and safety by controlling selective activation of the induction heating coil L corresponding to the position of the cookware C.

The main memory 111 and the main processor 112 may be implemented in separate integrated circuits (ICs) or implemented integrally in a single IC. The cookware detector 130 will now be described in detail.

Referring to FIG. 6, the cooking apparatus 1 may be equipped with the cookware detector 130.

The cookware detector 130 may determine whether the cookware C is placed on the cooking plate 102, e.g., whether the cookware C is placed on top of the induction heating coil L. when it is determined that the cookware C is placed on the cooking plate 102, the cookware detector 130 may determine a position where the cookware C is placed and identify the induction heating coil L corresponding to the position where the cookware C is placed.

The cookware detector 130 may include a capacitance detector 131 and a cookware detection controller 135.

The capacitance detector 131 may be connected to each electrode pair arranged on top of each induction heating coil L through an electrode connection terminal for detecting capacitance across the electrode pair. In this regard, the capacitance detector 131 may detect capacitance in various ways.

For example, the capacitance detector 131 may detect capacitance in a self method that detects capacitance using a capacitor arranged across the electrode pair, i.e., between the first electrode and the second electrode.

In another example, the capacitance detector 131 may apply a reference voltage to one of the first and second electrodes and detect capacitance between the first electrode and the second electrode, which varies as the cookware C approaches.

In an embodiment, the capacitance detector 131 may detect capacitance in a matrix method that uses switching devices to sequentially apply the reference voltage to the first and second electrodes and detect capacitance between the first electrode and the second electrode, which varies as the cookware C approaches.

In another embodiment, the capacitance detector 131 may include a processor having multiple output terminals to apply the reference voltage. Accordingly, the capacitance detector 131 may detect capacitance in an ADC method that sequentially applies the reference voltage to the first and second electrodes connected to the output terminals through the electrode connection terminal and detect capacitance between the first electrode and the second electrode, which varies as the cookware C approaches. In addition, the capacitance detector 131 may non-exclusively employ various known capacitance detection methods.

The cookware detection controller 135 may determine not only whether an object placed on the cooking plate 102 is the cookware C but also where the cookware C is located, based on the result of detection of the capacitance.

The cookware detection controller 135 may determine whether the cookware C is placed on the cooking plate 102 based on the capacitance received from the capacitance detector 131. For example, the cookware detection controller 135 may determine whether the cookware C is placed on the cooking plate 102 based on whether the capacitance exceeds a predetermined threshold.

In this regard, a first threshold may be set in advance to a capacitance value to estimate that the cookware C is placed on the cooking plate 102.

Furthermore, a second threshold may be set to a capacitance value to determine that there is a high chance that the cookware C is placed on the cooking plate 102, which may be set to be the same as the first threshold or set to be greater than the first threshold.

For example, the first threshold may be set based on at least one of the material property of the first and second electrodes, a relative ratio between areas of the first and second electrodes, a relative ratio between the total area occupied by the first and second electrodes and the area of the induction heating coil L, and a material property of the cookware C.

The material property of the cookware C is a property of the material itself of the cookware C, which may have a dielectric constant that the cookware heatable by the induction heating coil L has. In an embodiment, the first and second thresholds may be set taking into account the lowest of dielectric constants that the cookware heatable by the induction heating coil L has, without being limited thereto. Furthermore, the material property of the first and second electrodes refers to a property of the material itself employed in the first and second electrodes, including e.g., a dielectric constant of the material, without being limited thereto.

If the capacitance value is greater than the first threshold but less than the second threshold, the cookware detection controller 135 may re-determine whether it is right that the object placed on the cooking plate C is the cookware C. For example, the cookware detection controller 135 may cooperate with the driver 150 to apply a current to the induction heating coil L corresponding to an area where the cookware C is placed and detect the magnitude and phase of the current flowing in the induction heating coil L, thereby re-determining whether it is right that the cookware C is placed.

If the capacitance value is greater than both the first and the second thresholds, the cookware detection controller 135 may determine that the object placed on the cooking plate C is the cookware C without performing the re-determination.

In the meantime, when the electrode connection terminal is individually connected to each electrode pair through connection lines, the cookware detection controller 135 may determine a position of an electrode pair from which a capacitance value exceeding the first threshold is detected. Furthermore, the cookware detection controller 135 may determine that the cookware C is located over the induction heating coil L with the electric pair arranged on a side. For example, the cookware detection controller 135 may determine a position of the electrode pair using identification information and even the induction heating coil L corresponding to the position of the electric pair. This will be described in more detail later.

In another example, when the electrode connection terminal is connected to a plurality of electrode pairs through a single connection line, the cookware detection controller 135 may determine that the cookware C is located over an area to which an electrode group from which the capacitance value exceeding the first threshold is detected belongs. At this time, the cookware detection controller 135 may identify the electrode group and the area to which the electrode group belongs, based on at least one of a certain switching sequence and identification information. This will be described in more detail later.

The cookware detection controller 135 may cooperate with the driver 150 to apply a current to at least one induction heating coil L corresponding to the electrode group and detect the magnitude and phase of the current flowing in the induction heating coil L, thereby determining an accurate position of the cookware C.

In addition, the cookware detection controller 135 may perform various operations according to the connection method between the electrode connection terminal and the electrode pair. Operation of the cookware detector 130 will now be described in more detail, and for convenience of explanation, an occasion when the cookware detector 130 is installed in the cookware detection assembly will be focused.

Figure 11:
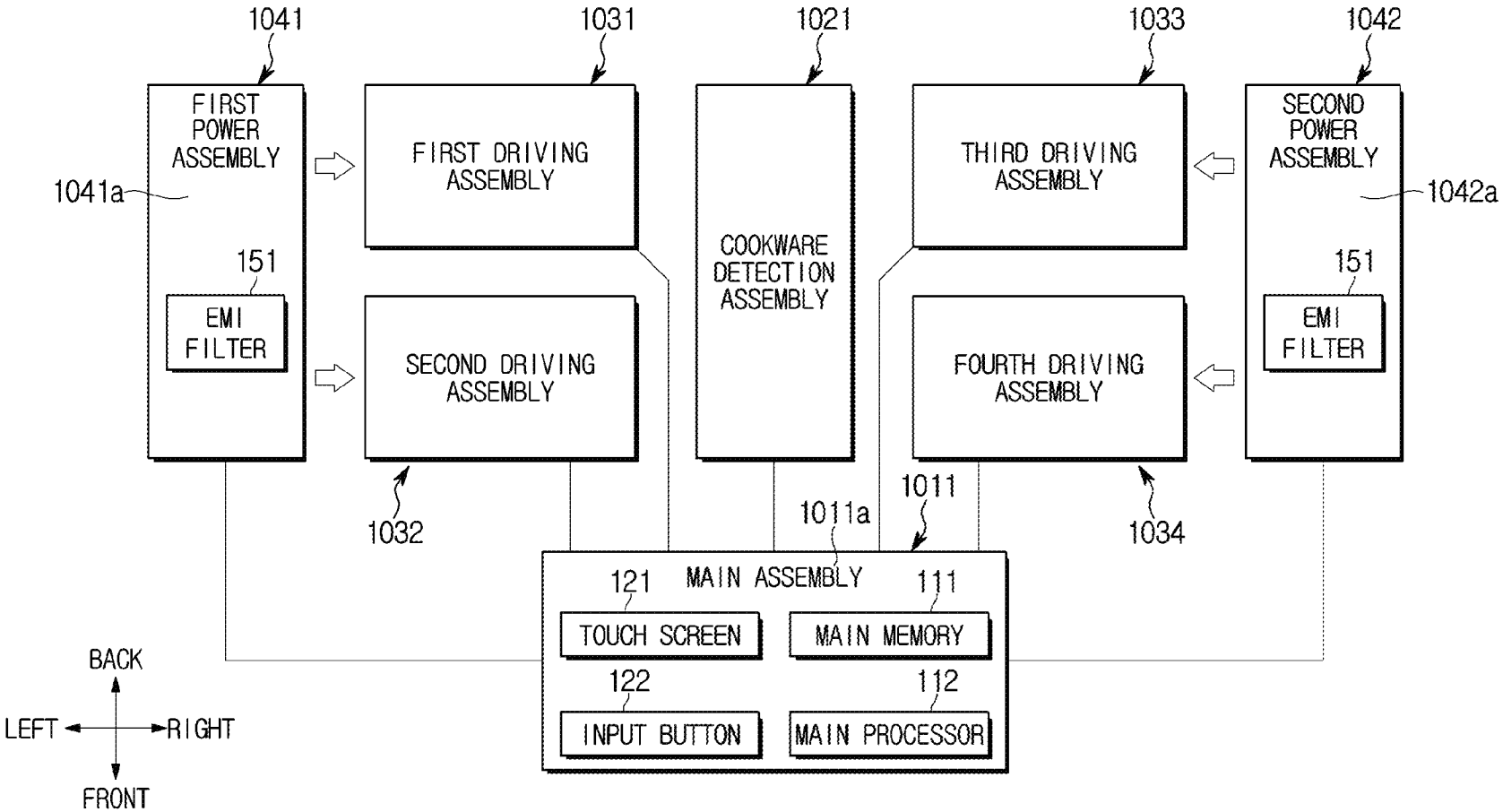
FIG. 11 schematically illustrates arrangement of printed circuit board (PCB) assemblies included in a cooking apparatus, according to an embodiment of the present disclosure.
Figure 12:
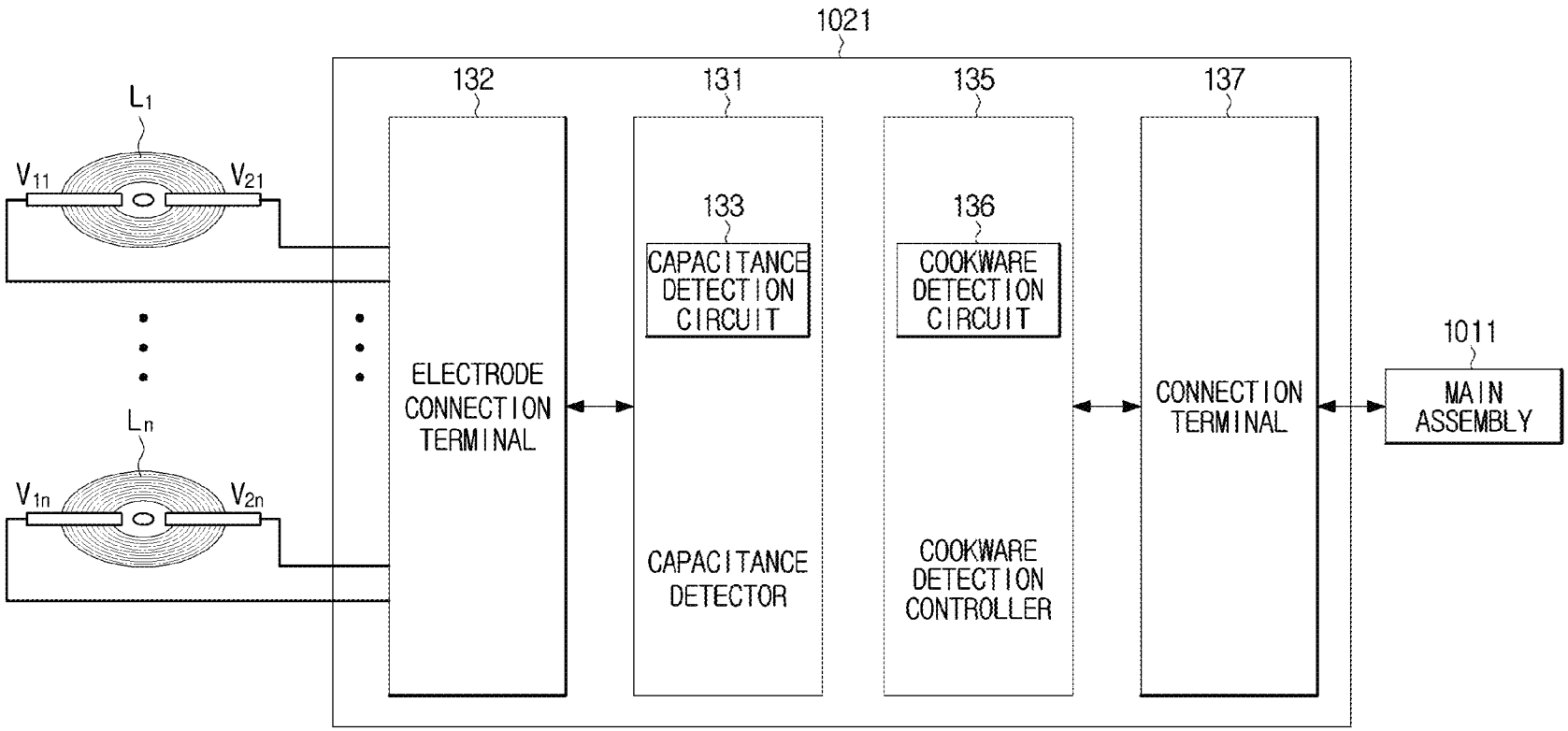
FIGS. 12 and 13 illustrate schematic control block diagrams of a cookware detection assembly included in a cooking apparatus, according to different embodiments of the present disclosure.
Figure 13:
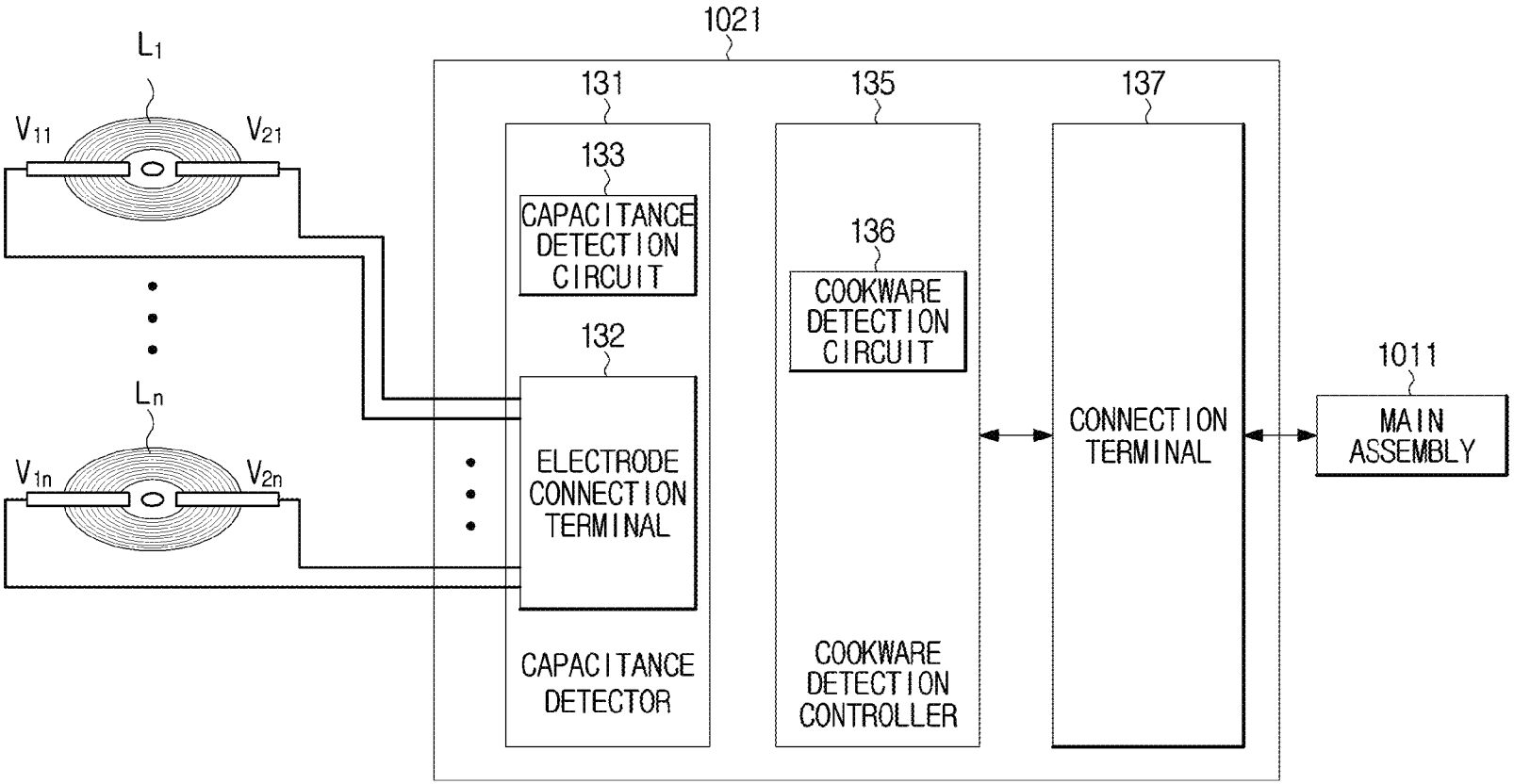
Figure 19:
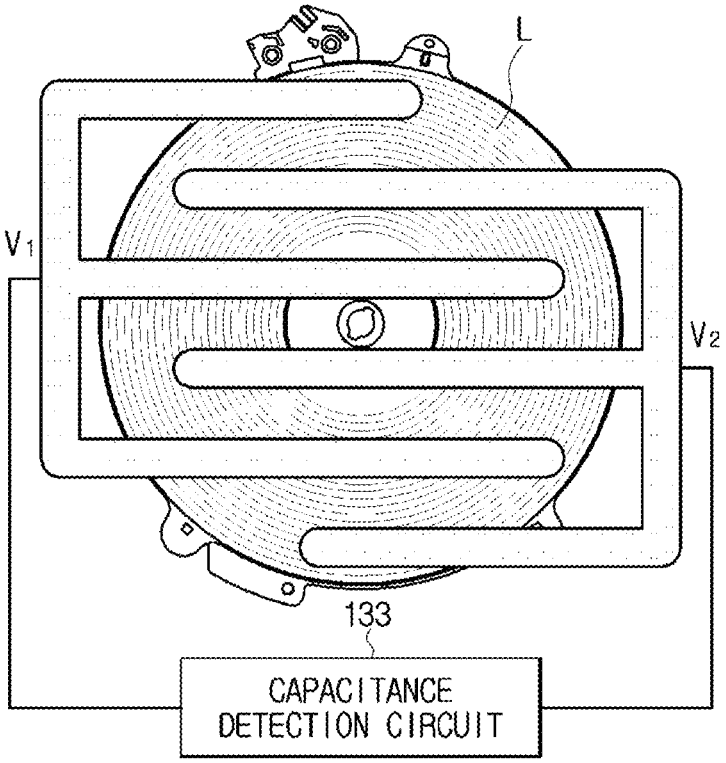
Figure 20:
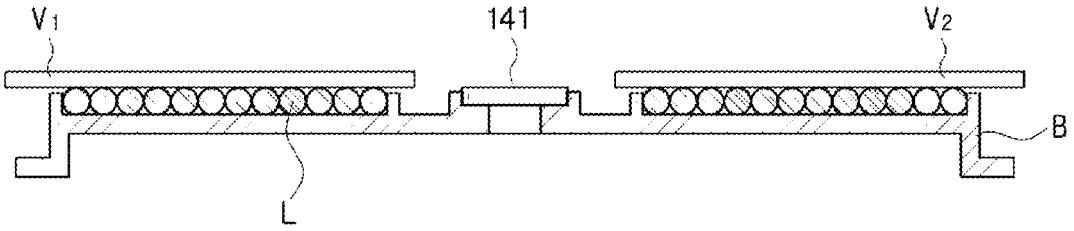
FIG. 20 illustrates a cross-sectional view of a base, a temperature sensor attached onto the base, and electrodes, according to an embodiment of the present disclosure.
Figure 21:
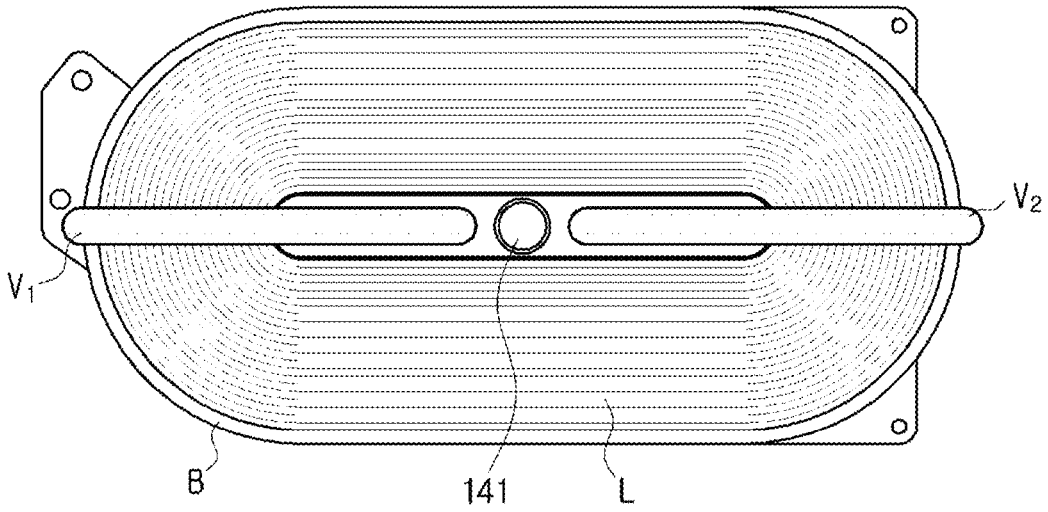
FIG. 21 illustrates a base, a temperature sensor attached onto the base, and electrodes viewed from a different side from the side of FIG. 20, according to an embodiment of the present disclosure.
Figure 22:
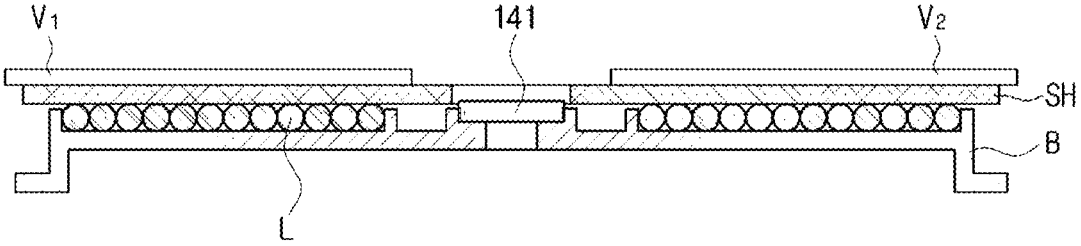
FIG. 22 schematically illustrates a base, an insulation sheet attached onto the base, and electrodes attached onto the insulation sheet, according to an embodiment of the present disclosure.
Figure 23:
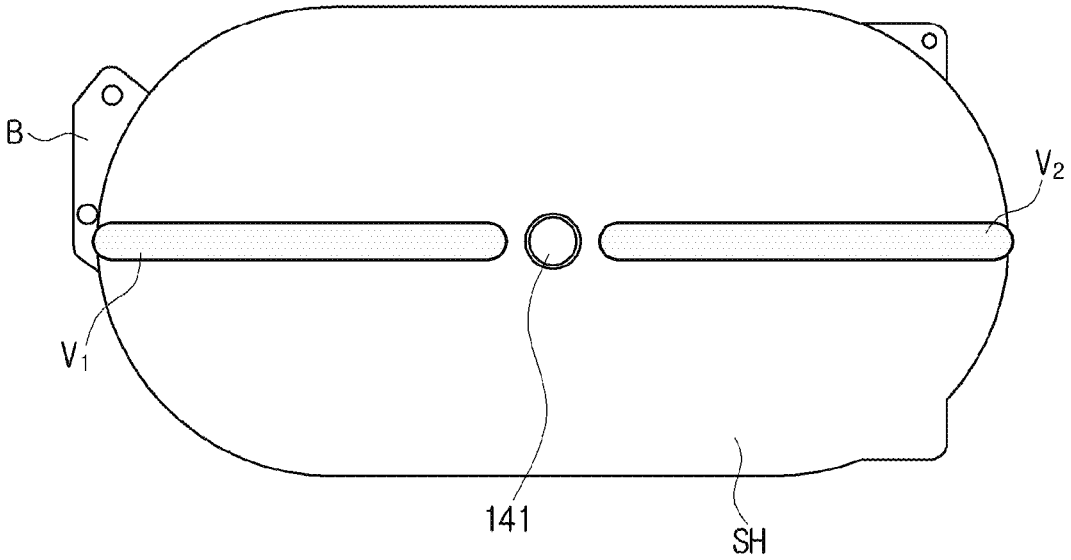
FIG. 23 schematically illustrates a base, an insulation sheet attached onto the base, and electrodes attached onto the insulation sheet viewed from a different side from the side of FIG. 22, according to an embodiment of the present disclosure.
Figure 24:
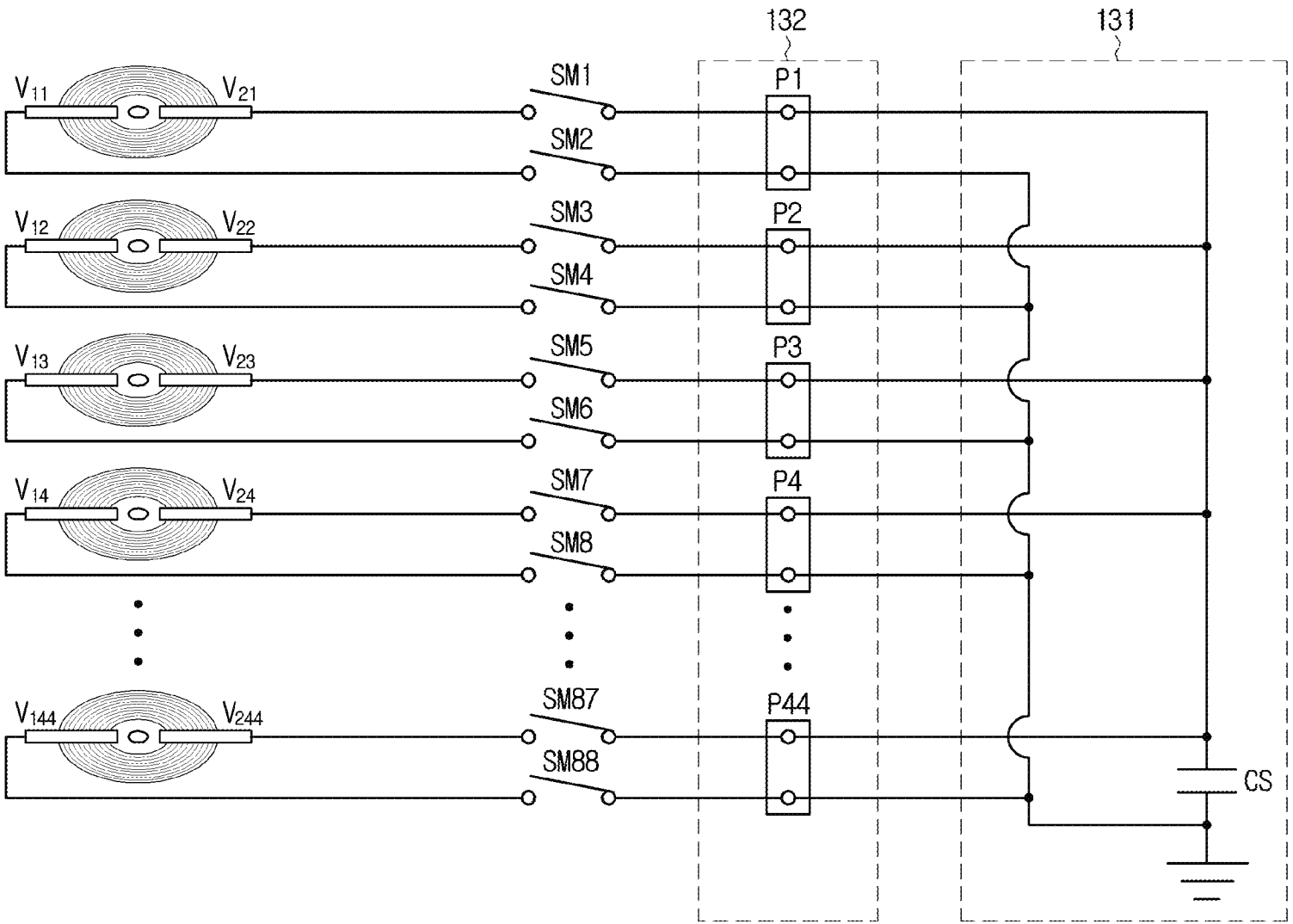
FIG. 24 illustrates a view for explaining a mechanism coupled with each electrode pair to detect the capacitance from a potential difference across the electrode pair, according to an embodiment of the present disclosure.
Figure 25:
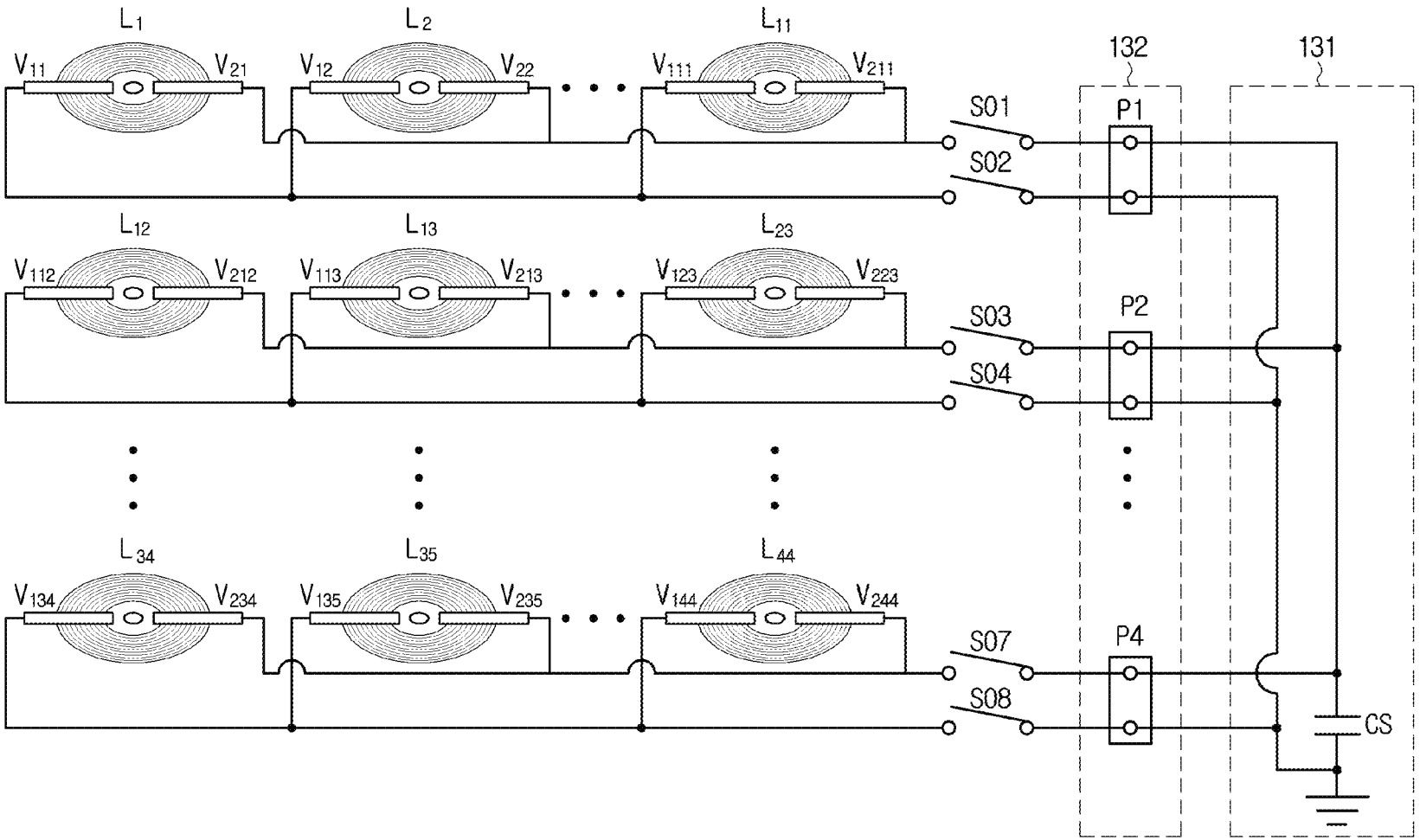
FIG. 25 illustrates a view for explaining a mechanism to detect capacitance from each electrode group when electrodes are grouped into a few groups, according to an embodiment of the present disclosure.

FIG. 11 schematically illustrates arrangement of PCB assemblies included in a cooking apparatus, according to an embodiment of the present disclosure, and FIGS. 12 and 13 illustrate schematic control block diagrams of a cookware detection assembly included in a cooking apparatus, according to different embodiments of the present disclosure. FIGS. 14 to 19 schematically illustrate forms of an induction heating coil and an electrode pair included in a cooking apparatus, according to different embodiments of the present disclosure, FIG. 20 illustrates a cross-sectional view of a base, a temperature sensor attached onto the base, and electrodes, according to an embodiment of the present disclosure, and FIG. 21 illustrates a base, a temperature sensor attached onto the base, and electrodes viewed from a different side from the side of FIG. 20, according to an embodiment of the present disclosure. FIG. 22 schematically illustrates a base, an insulation sheet attached onto the base, and electrodes attached onto the insulation sheet, according to an embodiment of the present disclosure, and FIG. 23 schematically illustrates a base, an insulation sheet attached onto the base, and electrodes attached onto the insulation sheet viewed from a different side from the side of FIG. 22, according to an embodiment of the present disclosure. FIG. 24 illustrates a view for explaining a mechanism coupled with each electrode pair to detect the capacitance due to a potential difference across the electrode pair, according to an embodiment of the present disclosure, and FIG. 25 illustrates a view for explaining a mechanism to detect capacitance from each electrode group when electrodes are grouped into a few groups, according to an embodiment of the present disclosure. The figures will now be described together to avoid overlapping explanation.

Referring to FIG. 11, the cooking apparatus 1 may include a main assembly 1011, a subassembly 1021, a first driving assembly 1031, a second driving assembly 1032, a third driving assembly 1033, a fourth driving assembly 1034, a first power assembly 1041, and a second power assembly 1042.

In this regard, the user interface 120, the cookware detector 130, the temperature detector 140, the driver 150, and the main controller 110 of the cooking apparatus 1 may be resulted from classification and grouping of a plurality of parts and circuits (e.g., a touch screen, an input button, a main memory, a main processor, etc.) included in the cooking apparatus 1 by function and operation. In other words, the user interface 120, the cookware detector 130, the temperature detector 140, the driver 150, and the main controller 110 may each refer to a collection of parts and circuits that perform the same or similar functions. The cookware detector 130, the temperature detector 140, the driver 150, and the main controller 10 may be incorporated in a single part, such as a single SoC, as described above, or may be installed in different PCB assemblies 1011, 1021, 1031, 1032, 1033, 1041, and 1042 as required.

For example, the main assembly 1011 may include the display 121, the input button 122, the main memory 111, and the main processor 112, and the components 121, 122, 131, and 132 may be mounted on a main PCB 1011*a*. In an embodiment, the main assembly 1011 may correspond to the main assembly 250 of FIG. 4.

In other words, the display 121 and the input button 12 may be included functionally in the user interface 120 and the main memory 111 and the main processor 112 may be included in the main controller 110, but the display panel 121, the input button 122, the main memory 111, and the main processor 112 may physically make up the main assembly 1011.

Furthermore, the main assembly 1011 may include a connection terminal to connect the main processor 112 to the cookware detection circuit 136 and/or the temperature detection circuit 142 of the cookware detection assembly 1021, and a connection terminal to connect the main processor 112 to the driving processor 157 of the first to fourth driving assemblies 1031, 1032, 1033, and 1034.

The first driving assembly 1031 may include the rectifying circuit 152, the inverter circuit 153, the distribution circuit 154, the current detection circuit 155, the driving memory 156, and the driving processor 157, which may be mounted on a first driving PCB 1031*a*. In other words, the first driving assembly 1031 may include the rectifying circuit 152, the inverter circuit 153, the distribution circuit 154, the current detection circuit 155, the driving memory 156, and the driving processor 157 may be functionally included in the driver 150, but may physically make up the first driving assembly 1031. The EMI filter 151 included in the driver 150 may be installed in the power assemblies 1041 and 1042 separately, as will be described below.

The first driving assembly 1031 may include a connection terminal to connect the driving processor 157 to the main processor 112 of the main assembly 1011, a connection terminal to connect the rectifying circuit 152 to the EMI filter 151 of the first power assembly 1041, and a connection terminal to connect the distribution circuit 154 to the plurality of induction heating coils L belonging to the first group 210.

The second to fourth driving assemblies 1032, 1033, and 1034 may have the same structure as the first driving assembly 1031. For example, the second driving assembly 1032 may include the rectifying circuit 152, the inverter circuit 153, the distribution circuit 154, the current detection circuit 155, the driving memory 156, and the driving processor 157, which may be mounted on a second driving PCB. Furthermore, the third and fourth driving assemblies 1033 and 1034 may each include the rectifying circuit 152, the inverter circuit 153, the distribution circuit 154, the current detection circuit 155, the driving memory 156, and the driving processor 157, which may be mounted on the third or fourth driving PCB.

The driving circuits included in the respective first to fourth driving assemblies 1031, 1032, 1033, and 1034 may apply the driving current to the plurality of induction heating coils L. For example, the driving circuits included in the four driving assemblies 1031, 1032, 1033, and 1034 may apply the driving current to 44 induction heating coils 201, and the 44 induction heating coils 201 may be divided into four coil groups G1, G2, G3, and G4, which receive the driving current from the four driving assemblies 1031, 1032, 1033, and 1034, respectively. For example, as shown in FIG. 4, the 44 induction heating coils 201 may be divided into the first coil group G1 receiving the driving current from the driving circuit of the first driving assembly 1031, the second coil group G2 receiving the driving current from the driving circuit of the second driving assembly 1032, the third coil group G3 receiving the driving current from the driving circuit of the third driving assembly 1033, and the fourth coil group G4 receiving the driving current from the driving circuit of the fourth driving assembly 1034.

In the meantime, as will be described below, the electrode groups may correspond to the coil groups, enabling the first to fourth driving assemblies 1031, 1032, 1033, and 1034 to more easily perform the re-determination process and the identification process to identify an induction heating coil corresponding to a position of the cookware based on the result of determination of the position of the cookware. This will be described in more detail later.

The first power assembly 1041 may include the EMI filter 151, which may be mounted on a first power PCB 1051*a*. In other words, functionally, the EMI filter 151 may be included in the driver 150, but may physically make up the first power assembly 1041. when needed, the fuse F (see FIG. 6) and the relay R (see FIG. 6) may be included in the first power assembly 1041.

Furthermore, the first power assembly 1041 may include a connection terminal to connect the EMI filter to an external power source, and a connection terminal to connect the EMI filter 151 to the rectifying circuit 152 of the first/second driving assembly 1031/1032. The second power assembly 1042 may have the same structure as the first power assembly 1042.

Referring to FIG. 12, the cookware detection assembly 1021 may include an electrode connection terminal 132 connected to the respective electrode pairs each arranged on a side of each of the plurality of induction heating coils L, i.e., to a plurality of first electrodes V11-V1*n* and a plurality of second electrodes V21-V2*n*, through connection lines, the capacitance detector 131 connected to the electrode connection terminal 132 for detecting capacitance, the cookware detection controller 135 for determining whether and where the cookware C is placed on the cooking plate 102, and a connection terminal 137 for connection with external components.

For example, the electrode connection terminal 132 may be connected to each pair of the first electrodes V11 to V1*n* and the second electrodes V21 to V2*n* arranged on a side of each of n (n≥1) induction heating coils L through wires. The electrode connection terminal 132 may be connected to each pair of the first electrodes V11 to V1*n* and the second electrodes V21 to V2*n* arranged on top of each of n (n≥1) induction heating coils L through various methods.

A pair of the plurality of first electrodes V11 to V1*n* and second electrodes V21 to V2*n* may be located on a side of each of the plurality of induction heating coils L1 to L44. In the following description, an occasion when the plurality of first electrodes V11 to V1*n* and second electrodes V21 to V2*n* may be located on top of each of the plurality of induction heating coils L1 to L44 will be focused, but embodiments of the present disclosure are not limited thereto. For example, the electrodes may be arranged at any places from which the cookware C placed on the cooking plate 102 may be detected.

The plurality of first electrodes V11 to V1*n* and second electrodes V21 to V2*n* may be implemented in various forms and located on top of each of the plurality of induction heating coils L1 to L44, and connected to the capacitance detection circuit 133 through the electrode connection terminal 132.

Figure 14:
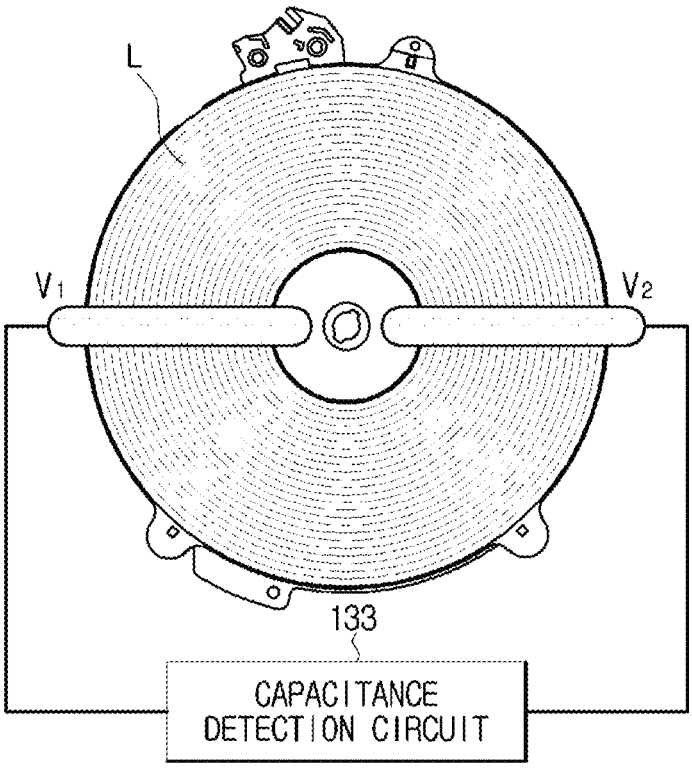
FIGS. 14 to 19 schematically illustrate forms of an induction heating coil and an electrode pair included in a cooking apparatus, according to different embodiments of the present disclosure.
Figure 15:
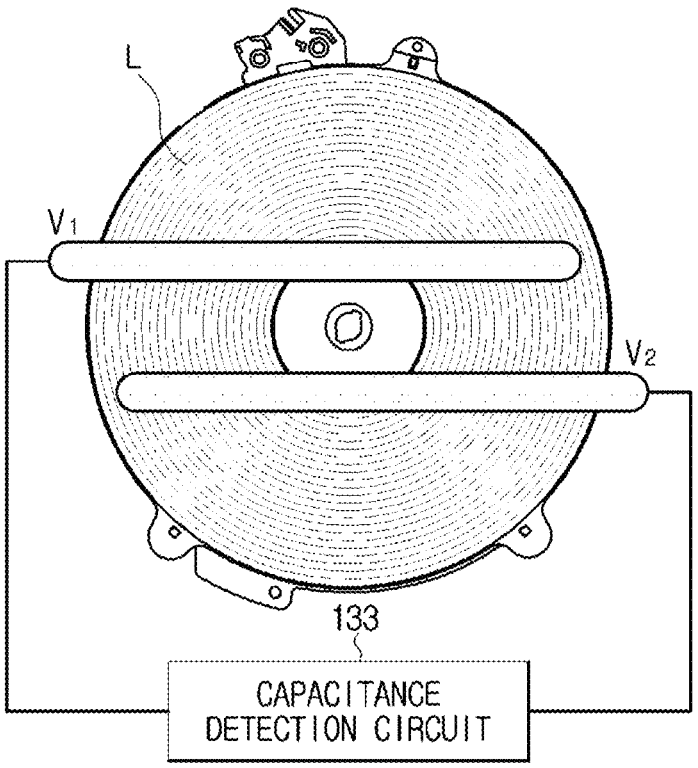

For example, the first electrode V1 and the second electrode V2 may be implemented in the form of bars, as shown in FIG. 14, and may be located on the left and right sides, respectively, with respect to the center of the induction heating coil L. The first electrode V1 and the second electrode V2 are not limited to having the length as shown in FIG. 14, but may be implemented in the form of bars having the length as shown in FIG. 15.

Figure 16:
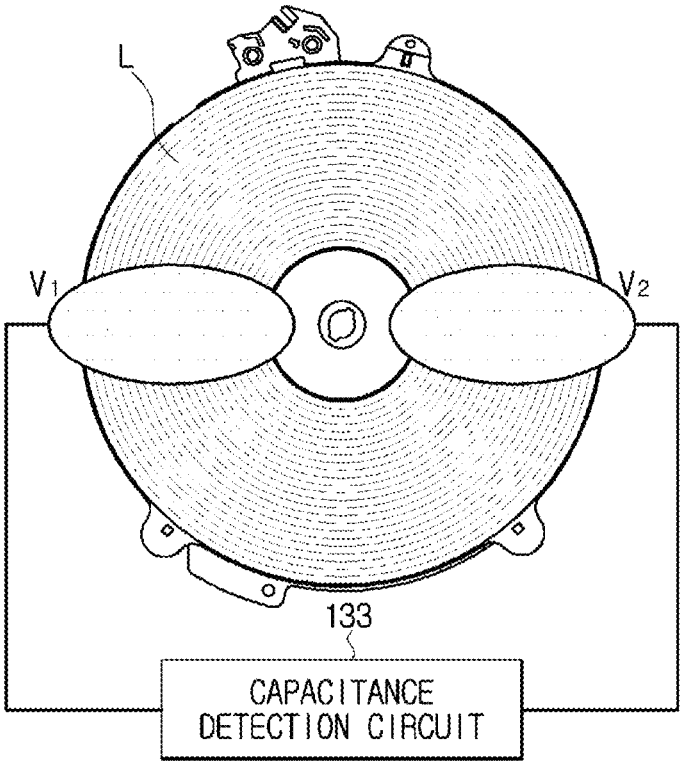
Figure 17:
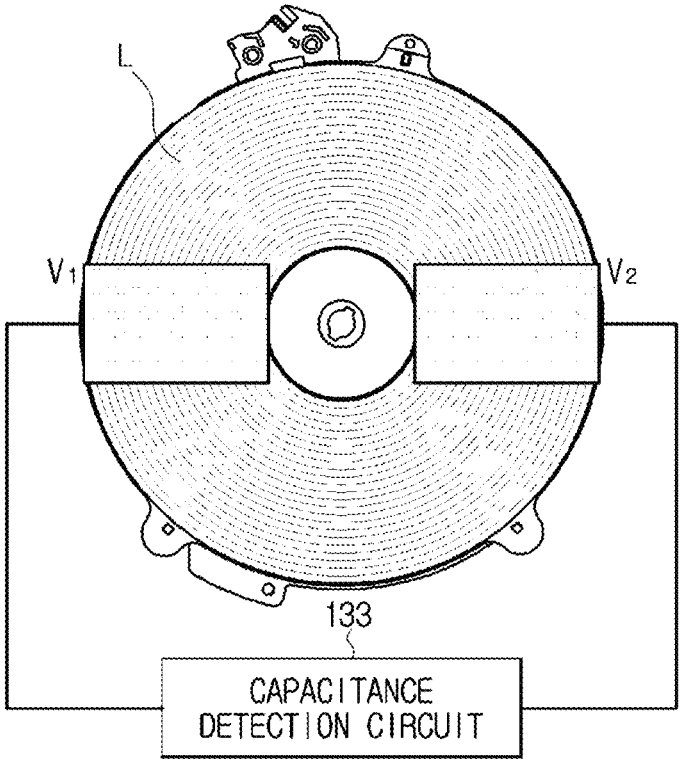

In another example, the first electrode V1 and the second electrode V2 may be implemented in the form of ellipses, as shown in FIG. 16, and may be located on the left and right sides, respectively, with respect to the center of the induction heating coil L. In still another example, the first electrode V1 and the second electrode V2 may be implemented in the form of rectangles, as shown in FIG. 17, and may be located on the left and right sides, respectively, with respect to the center of the induction heating coil L.

Figure 18:
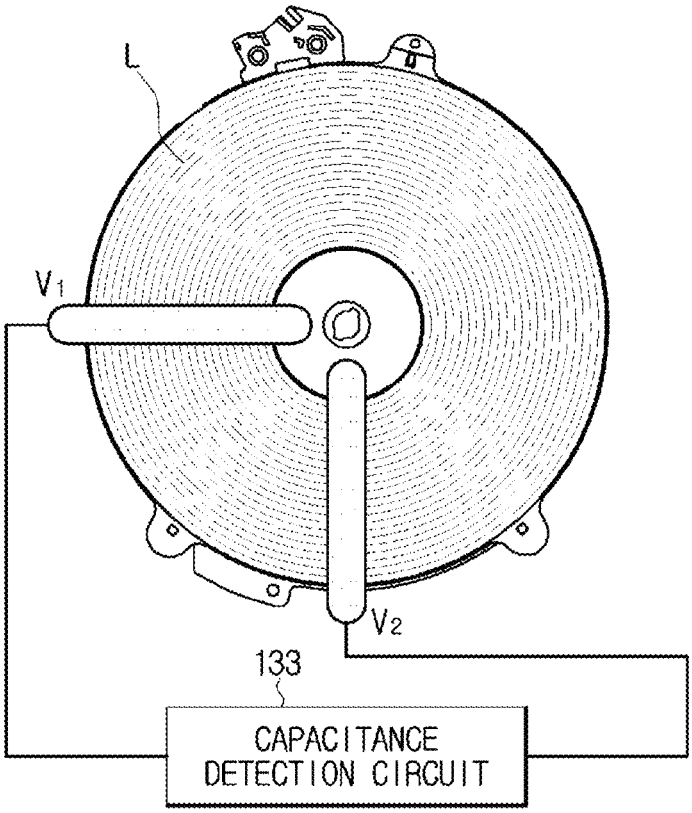

In yet another example, as shown in FIG. 18, the first electrode V1 may be implemented in the form of a bar located at nine o'clock from the center of the induction heating coil L, and the second electrode V2 may be implemented in the form of a bar located at six o'clock from the center of the induction heating coil L. In still another example, the first electrode V1 and the second electrode V2 may be implemented in the form of tridents, as shown in FIG. 19, and may be located on top of the induction heating coil L.

Besides, the first and second electrodes V1 and V2 may be implemented in various known forms, such as symbol, polygon, letter, or number, without being limited thereto. Furthermore, the first electrode V1 and the second electrode V2 may not be limited to being implemented in the same form, but may be implemented in different forms and even in different areas.

A threshold may be set to determine whether the cookware C is located on top of an induction heating coil L, i.e., whether the cookware C is placed on the cooking plate 102 based on an area ratio between the first and second electrodes V1 and V2, a material of the first and second electrodes V1 and V2, a relative ratio between an area occupied by the first and second electrodes V1 and V2 and an area of the induction heating coil L, etc. This will be described in more detail later.

Furthermore, a ratio between the total area of the first and second electrodes V1 and V2 and an area of the induction heating coil L arranged underneath the first and second electrodes V1 and V2 may be set in advance. For example, the first and second electrodes V1 and V2 may be implemented with a material that is less affected by the magnetic field produced by the induction heating coil L. In an embodiment, the first and second electrodes V1 and V2 may be implemented with a nonferrous metal, such as aluminum, without being limited thereto.

However, when the total area of the first and second electrodes V1 and V2 is much larger than the area of the induction heating coil L arranged underneath the first and second electrodes V1 and V2, it affects the magnetic field by the induction heating coil L, hindering the cookware C from being heated smoothly. Accordingly, in an embodiment of the present disclosure, the ratio between the total area of the first and second electrodes V1 and V2 and an area of the induction heating coil L arranged underneath the first and second electrodes V1 and V2 may be set in advance for both capacitance detection and heating of the cookware C to be smoothly performed.

For example, the ratio between the total area of the first and second electrodes V1 and V2 and an area of the induction heating coil L arranged underneath the first and second electrodes V1 and V2 may be set to 50% or less, without being limited thereto.

Furthermore, data of the ratio between the total area of the first and second electrodes V1 and V2 and an area of the induction heating coil L arranged underneath the first and second electrodes V1 and V2 may be stored in advance, and based on this, the driver 150 may control application of the driving current.

The first electrode V1 and the second electrode V2 may be located on top of the induction heating coil L in various methods.

Referring to FIGS. 20 and 21, the induction heating coil L may be received and fixed in a base B. Various known materials durable under high temperatures may be employed for the base B. For example, a material that is durable under the temperatures of 200 degrees or more may be employed for the base B.

The temperature sensor 141 may be attached onto the center of the base B, and each of the first and second electrodes V1 and V2 may be attached on a side of the base B by means of an adhesive material. The adhesive material may use a material durable under a certain temperature or more, e.g., silicon, without being limited thereto.

Alternatively, the base B and the cooking plate 102 may be designed to closely contact each other. Accordingly, the first and second electrodes V1 and V2 may not be attached by means of any adhesive material, but may be fixed by pressure between the base B and the cooking plate 102.

In the meantime, when the first and second electrodes V1 and V2 are fixed by the adhesive material, the height of the adhesive material may be preset taking into account the height of the temperature sensor 141, for more accurate measurement of temperature.

For example, from the bottom surface of the cooking plate 102, the height of the adhesive material may be preset such that the temperature sensor 141 is closer to the lower surface of the cooking plate 102 than to the first and second electrodes V1 and V2. Accordingly, even when the first and second electrodes V1 and V2 are added in the cooking apparatus 1 in accordance with an embodiment, measurement of the temperature may be smoothly performed.

Besides, the first electrode V1 and the second electrode V2 may be located on top of the induction heating coil L in various methods.

Referring to FIGS. 22 and 23, the cooking apparatus 1 may further include an insulation sheet SH placed on top of the base B. The first electrode V1 and the second electrode V2 may be attached to the upper surface of the insulation sheet SH by means of an adhesive material.

In this regard, the height of the adhesive material may be preset taking into account not only the height of the temperature sensor 141 but also the height of the insulation sheet SH. For example, as described above, from the bottom surface of the cooking plate 102, the height of the adhesive material may be preset such that the temperature sensor 141 is closer to the lower surface of the cooking plate 102 than to the first and second electrodes V1 and V2. How to connect the electrode connection terminal 132 and the electrode pair will now be described.

The plurality of first electrodes V11 to V1*n* and the plurality of second electrodes V21 to V2*n* may be connected to the electrode connection terminal 132 via connection lines, and the capacitance detector 131 may detect a voltage across at least one electrode pair of the plurality of first electrodes V11-V1*n* and the plurality of the second electrodes V21-V2*n* to measure capacitance.

The electrode connection terminal 132 may be connected to the plurality of first electrodes V11 to V1*n* and the plurality of second electrodes V21 to V2*n* in various ways. The electrode connection terminal 132 and the plurality of first electrodes V11 to V1*n* and the plurality of second electrodes V21 to V2*n* may be connected in various ways based on the number of port terminals, i.e., connection ports equipped in the electrode connection terminal 132, the number of the plurality of first electrodes V11 to V1*n* and the plurality of second electrodes V21 to V2*n*, and a method for detecting capacitance.

For example, the electrode connection terminal 132 may be connected to the plurality of first electrodes V11 to V1*n* and the plurality of second electrodes V21 to V2*n* individually. In an embodiment, among the first electrodes V11 to V1*n*, the first electrode V11 arranged on top of the first induction heating coil L1 may be connected to a first connection port equipped in the electrode connection terminal 132, and among the second electrodes V21 to V2*n*, the second electrode V1 arranged on top of the first induction heating coil L1 may be connected to a second connection port equipped in the electrode connection terminal 132. The rest of the first electrodes V12 to V1*n* and second electrodes V22 to V2*n* may also be individually connected in this way.

Alternatively, the connection ports equipped in the electrode connection terminal 132 may each be implemented to be connected to two lines. For example, the first electrode V11 arranged on top of the first induction heating coil L1 among the first electrodes V11 to V1*n*, and the second electrode V21 arranged on top of the first induction heating coil L1 among the second electrodes V21 to V2*n* may be connected to a first connection port equipped in the electrode connection terminal 132. Furthermore, the first electrode V12 arranged on top of the second induction heating coil L2 among the first electrodes V11 to V1*n*, and the second electrode V22 arranged on top of the second induction heating coil L2 among the second electrodes V21 to V2*n* may be connected to a second connection port equipped in the electrode connection terminal 132. The rest of the first electrodes V13 to V1*n* and second electrodes V23 to V2*n* may also be connected in this way.

Referring to FIG. 24, the electrode connection terminal 132 may include first to forth-fourth connection ports P1 to P44. In this regard, the first electrode V11 arranged on top of the first induction heating coil L1 among the first electrodes V11 to V1*n*, and the second electrode V21 arranged on top of the first induction heating coil L1 among the second electrodes V21 to V2*n* may be connected to a first connection port P1 equipped in the electrode connection terminal 132. Furthermore, the first electrode V12 arranged on top of the second induction heating coil L2 among the first electrodes V11 to V1*n*, and the second electrode V22 arranged on top of the second induction heating coil L2 among the second electrodes V21 to V2*n* may be connected to a second connection port P2 equipped in the electrode connection terminal 132. The rest of the first electrodes V13 to V1*n* and second electrodes V23 to V2*n* may also be connected in this way.

In a case of detecting capacitance by a self method, the capacitance detection circuit 133 may detect capacitance by connecting the first electrode V11-V1*n* and the second electrode V21-V2*n* connected through the connection ports P1-P44 to both ends of the capacitor Cs.

The capacitance detection circuit 133 may control electrodes connected across the capacitor Cs by controlling the switching devices SM1-SM88 to be turned on or off. The capacitor Cs equipped in the capacitance detection circuit 133 is not only in the singular, but may also in the plural, in which case the circuit configuration may vary as well.

In another example, the plurality of first electrodes V11 to V1*n* and the plurality of second electrodes V21 to V2*n* may be grouped in various ways and then connected to the electrode connection terminal 132.

The plurality of first electrodes V11 to V1*n* and second electrodes V21 to V2*n* may be divided into at least one electrode group. For example, in the case that there are 44 induction heating coils L arranged in the cooking apparatus 1, there may be 44 first electrodes V11 to V144 and 44 second electrodes V21 to V244, which may be grouped into four electrode groups.

The electrode groups may or may not correspond to the aforementioned coil groups, without being limited thereto. For example, a first electrode group may include 11 first electrodes V11 to V111 and 11 second electrodes V21 to V211, and a second electrode group may include 11 first electrodes V112 to V122 and 11 second electrodes V212 to V222, and a third electrode group may include 11 first electrodes V123 to V133 and 11 second electrodes V223 to V233, and a fourth electrode group may include 11 first electrodes V134 to V144 and 11 second electrodes V234 to V244.

The first electrodes and second electrodes belonging to each of the first to fourth electrode groups are grouped as one to be connected to the electrode connection terminal 132.

Referring to FIG. 25, the first electrodes V11-V111 and the second electrodes V21-V211 belonging to the first electrode group may be connected in parallel with each other and connected to the first connection port P1 through switching devices SO1 and SO2. The first electrodes V112-V122 and the second electrodes V212-V222 belonging to the second electrode group may be connected in parallel with each other and connected to the second connection port P2 through switching devices SO3 and SO4. The rest of the first electrodes V123 to V144 and second electrodes V223 to V244 may also be connected in this way.

The capacitance detection circuit 133 may control the switching devices SO1 to SO8 to be turned on or off in a predetermined switching sequence to detect capacitance from the potential difference between the first electrode V11-V144 and the second electrode V21-V244 located on top of each of the 44 induction heating coils L1-L44. In this case, the cooking apparatus 1 in accordance with the embodiments has an advantage of being able to detect capacitance from the potential difference between the first electrode V11-V144 and the second electrode V21-V244 located on top of each of the 44 induction heating coils L1-L44, even when the electrode connection terminal 132 has four connection ports.

However, even when it is determined based on the capacitance that the cookware C is placed on the cooking plate 102, the accurate position may not be determined. Accordingly, in an embodiment, the cookware detection controller 135 control a driving current to be applied to at least one induction heating coil related to an electrode group from which a capacitance value is detected, and detect the magnitude and phase of a current in the at least one induction heating coil to which the driving current is applied, thereby identifying the induction heating coil corresponding to an area in which the cookware is placed.

For example, when a capacitance value is detected from the first electrode group corresponding to the first coil group when coil groups are formed to correspond to electrode groups, the cookware detection controller 135 may send a control signal to the first driving assembly 1031 to apply the driving current to the first to eleventh induction heating coils L1 to L11. This will be described in more detail later.

In a case that the first electrode V1 and the second electrode V2 are connected to the electrode connection terminal 132 through switching devices, the capacitance detection circuit 133 may control the plurality of switching devices to be turned on or off in a predetermined switching sequence. Accordingly, as will be described below, the cookware detection controller 135 may identify not only the first and second electrodes V1 and V2, from which a capacitance value is detected, but also the induction heating coil underneath the first and second electrodes V1 and V2, based on the predetermined switching sequence. This will be described in more detail later.

In the case that the plurality of first electrodes V11-V144 and the plurality of second electrodes V21-V244 are connected to the electrode connection terminal 132, as shown in FIG. 24 or 25, the switching devices SM1-SM88 of FIG. 24 or the switching devices SO1 to SO8 may or may not be included in the cookware detection assembly 1021, without being limited thereto.

The capacitance detection circuit 133 may send data about the capacitance value to the cookware detection controller 135, which may in turn determine whether the cookware C is placed on the cooking plate 102 based on the data about the capacitance value.

If it is determined that the cookware C is placed on the cooking plate 102, the cookware detection controller 135 may determine an accurate position of the cookware C and then cooperate with the driver 150 to selectively drive the induction heating coil required to heat the cookware C. The cookware detection controller 135 will now be described in detail.

The cookware detection assembly 1021 may include the cookware detection controller 135. The general operation of the cookware detection controller 135 was described above, so the overlapping description will not be repeated.

The cookware detection controller 135 may control overall operation of the components in the cookware detection assembly 1021. For example, the cookware detection controller 135 may control operation of the capacitance detector 131 with control signals.

In another example, the cookware detection controller 135 may exchange various signals with the main assembly 1011 through the connection terminal 137. In still another example, the cookware detection controller 135 may receive power from an internal power source of the cookware detection assembly 1021 or an external power source to supply driving power to the components in the cookware detection assembly 1021.

Referring to FIG. 12, the cookware detection controller 135 may include the cookware detection circuit 136. The cookware detection circuit 136 may determine whether the cookware C is placed on the cooking plate 102 based on the capacitance value received from the capacitance detector 131. For example, the cookware detection circuit 136 may determine whether the cookware C is placed on the cooking plate 102 based on whether the received capacitance value exceeds a predetermined threshold. The threshold may include the first threshold and the second threshold as described above.

In the following description, an occasion when a connection port of the electrode connection terminal 132 and an electrode pair including the first electrode V1 and the second electrode V2 are individually connected will be focused.

In the case that a connection port of the electrode connection terminal 132 and an electrode pair are individually connected, the cookware detection circuit 136 may determine whether to perform a re-determination process based on whether the capacitance value exceeds only the first threshold or exceeds both the first and second thresholds. The re-determination process may refer to a series of processes to re-determine whether the cookware C is placed on the cooking plate 102 when the probability of the cookware C being placed on the cooking plate 102 is less than a certain probability as a result of determination from the detected capacitance value.

For example, when the capacitance value exceeds only the first threshold, the cookware detection circuit 136 may perform the re-determination process. At this time, the cookware detection circuit 136 may send a control signal to a driving assembly among the first to fourth driving assemblies 1031, 1032, 1033, and 1034 to drive at least one induction heating coil corresponding to a position at which the capacitance value is detected.

In an embodiment, a capacitance value detected from the first and second electrodes V11 and V21 arranged on top of the first induction heating coil L1 may be greater than the first threshold but less than the second threshold. The cookware detection circuit 136 then sends a control signal to the first driving assembly 1031 through the connection terminal 137 for the driving circuit in the first driving assembly 1031 to apply the driving current to the first induction heating coil L1.

At this time, the cookware detection circuit 136 may use identification information to determine an induction heating coil corresponding to the first and second electrodes V1 and V2 from which the capacitance value is detected. The identification information may be information used to identify an area from which the capacitance value is detected, including a number of the port in the electrode connection terminal 132, a product number for each port, etc. Alternatively, the identification number may be information used to identify an electrode pair, including identification numbers of the first electrode V1 and the second electrode V2, a product number, etc., without being limited thereto.

For example, as shown in FIG. 24, the first connection port P may be designed to be connected to the first electrode V11 and the second electrode V21 arranged on top of the first induction heating coil L, and this design information may be included in the identification information. In an embodiment, the identification information may include data in which the port number of the first connection port P1 is mapped to the position of the electrode pair connected to the first connection port P1. The identification information may be stored in a memory equipped in the cookware detection assembly 1021 or the main memory 111 equipped in the main assembly 1011, without being limited thereto.

The cookware detection circuit 136 uses the identification information to identify an induction heating coil, and sends a resultant control signal to apply the driving current to the identified induction heating coil.

When the driving current is applied to the induction heating coil L while the cookware C is placed thereon, the magnitude and phase of the current may be changed. For example, the magnitude of the current in the induction heating coil L while the cookware C is placed thereon may be smaller than that in the induction heating coil L while the cookware C is not placed thereon. Furthermore, the phase of the current in the induction heating coil L while the cookware C is placed thereon may be delayed than that in the induction heating coil L while the cookware C is not placed thereon.

Data about an extent of change in magnitude and phase may be stored in a memory equipped in the cookware detection assembly 1021 or the main memory 111 equipped in the main assembly 1011, without being limited thereto. Accordingly, the cookware detection circuit 136 may receive data of a result of application of the driving current, compare the data with the aforementioned data, and re-determine whether it is right that the cookware C is placed on the cooking plate 102.

The cooking apparatus 1 using the induction heating coil L is not available to all types of cookware. Furthermore, when an induction heating coil L is selectively driven while the position where the available cookware is placed has not been accurately determined, it just ends up waste of energy.

Accordingly, the cooking apparatus 1 in accordance with an embodiment of the present disclosure may increase accuracy in locating the cookware by re-determining whether it is right that the cookware C is placed on the cooking plate 102 and when it is right that the cookware C is placed on the cooking plate 102, re-determining which induction heating coil is to be driven.

However, in the case of performing the re-determination process by applying the driving current to the induction heating coil L, energy consumption may increase and noise may occur due to the current flowing in the induction heating coil L. Accordingly, in an embodiment, the cookware detection circuit 136 may determine that the cookware C is placed on the cooking plate 102 without performing the re-determination, when the capacitance value exceeds a preset second threshold.

The cookware detection circuit 136 may identify the induction heating coil L corresponding to the position of the cookware C based on the identification information. For example, when a plurality of electrode pairs are connected to the respective connection ports, i.e., connected one to one, the cookware detection circuit 136 may identify the induction heating coil L arranged underneath the electrode pair from which the capacitance value is detected, based on the identification information.

Alternatively, when a capacitor CS is connected to a plurality of electrode pairs as shown in FIG. 24, or when a plurality of electrode pairs are grouped and connected to the electrode connection terminal 132 as shown in FIG. 25, the cookware detection circuit 136 may determine an area of an electrode group from which a capacitance value exceeding the second threshold is detected, based on at least one of the identification information and predetermined switching sequence.

In a specific example, when a capacitance value is detected by the single capacitor CS as shown in FIG. 25, the capacitance detection circuit 133 may sequentially detect capacitance values from the respective electrode groups by sequentially turning on or off the first to eighth switching devices SO1 to SO8 in a predetermined sequence.

The cookware detection circuit 136 may then determine an electrode group from which the capacitance value is detected, based on the predetermined switching sequence. For example, the capacitance detection circuit 133 may sequentially turn on the four electrode groups of FIG. 25 for a predetermined period of time. The cookware detection circuit 136 may then determine an electrode group from which the capacitance value is detected by determining switching devices turned on in a time for which the capacitance value is detected among the first to eighth switching devices SO1 to SO8 based on the predetermined switching sequence.

The cookware detection circuit 136 may identify at least one induction heating coil corresponding to the electrode group, and enable the driving current to be applied to the identified at least one induction heating coil by a control signal. The cookware detection circuit 136 may receive a change in magnitude and phase of the current in the at least one induction heating coil as the driving current is applied thereto, and based on the change, may identify an induction heating coil corresponding to the position of the cookware C.

The circuit configuration may vary by at least one of a connection form between the electrode pairs and the electrode connection terminal 132, an arrangement form of the switching devices, and the number of capacitors arranged in the capacitance detection circuit 133. Even in this case, the cookware detection circuit 136 may identify at least one induction heating coil arranged underneath the electrode pair from which the capacitance value is detected or determine an electrode group to which the electrode pair from which the capacitance value is detected belongs, based on at least one of the predetermined switching sequence and the identification information.

The capacitance detection circuit 133 may send the result of identification of the at least one induction heating coil L corresponding to the position of the cookware C based on the result of determination of the position of the cookware C to the main assembly 1011 through the connection terminal 137. The main assembly 1011 may then control the display 121 to display the result of determination of the position of the cookware C, and the user may check the position of the cookware C through the display 121 and input a command to control the output intensity.

Referring to FIG. 13, the capacitance detector 131 may include the electrode connection terminal 132. In other words, depending on a method of configuring the electrode connection terminal 132 and the capacitance detection circuit 133, the electrode connection terminal 132 may be included in the capacitance detector 131, without being limited thereto. Detailed description of FIG. 13 will be omitted because the configuration was already described except that the electrode connection terminal 132 is included in the capacitance detector 131. An operation flow of the cooking apparatus will now be described.

Figure 26:
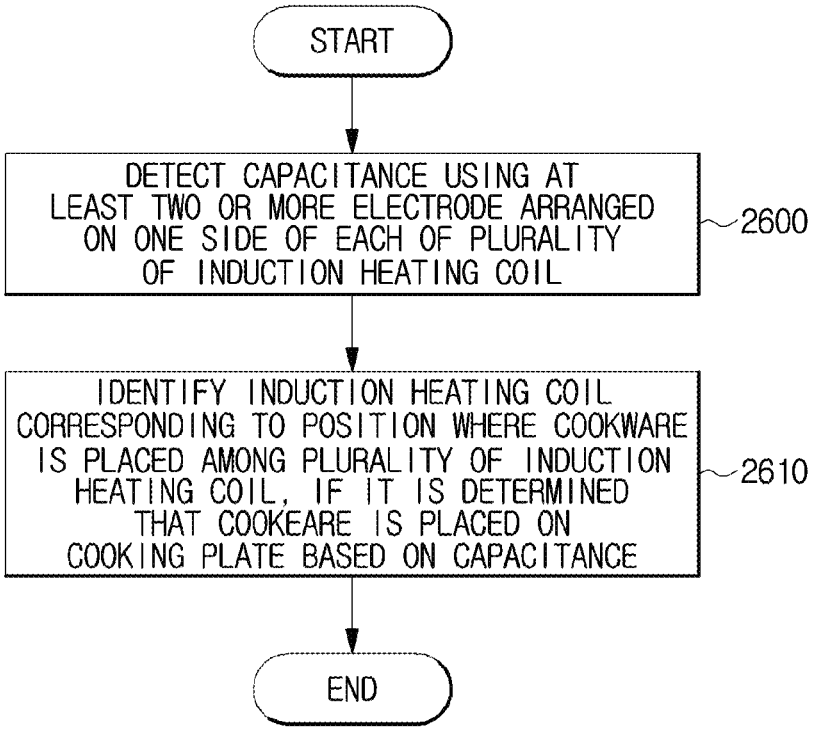
FIG. 26 illustrates a flowchart schematically of an operation of a cooking apparatus for identifying the cookware and determining a position of the cookware, according to an embodiment of the present disclosure.

FIG. 26 illustrates a flowchart schematically of an operation of a cooking apparatus for identifying the cookware and determining a position of the cookware, according to an embodiment of the present disclosure.

Referring to FIG. 26, the cooking apparatus detects capacitance using at least two or more electrodes arranged on one side of each of a plurality of induction heating coils, in 2600. As described above, the at least two or more electrodes may be arranged on one side of the induction heating coil, e.g., between the induction heating coil and the cooking plate, or on one side of the base in which the induction heating coil is received, or on one face of the insulation sheet arranged on top of the induction heating coil.

The cooking apparatus may detect capacitance from a potential difference that occurs as the cookware approaches to the at least two or more electrodes. At this time, the cooking apparatus may detect the capacitance in a self method that detects the capacitance based on the potential difference of the at least two or more electrodes themselves, as described above. Alternatively, the cooking apparatus may detect the capacitance in a matrix method or ADC method that detects the capacitance based on a potential difference by applying a reference voltage to one of the at least two or more electrodes and detects the potential difference between the electrode to which the reference voltage is applied and the other electrode.

The cooking apparatus determines whether the cookware is placed on the cooking plate based on the capacitance, and when it is determined that the cookware is placed on the cooking plate, identifies an induction heating coil corresponding to a position where the cookware is placed among the plurality of induction heating coils, in 2610.

The cooking apparatus may compare the capacitance with a preset threshold to determine whether the cookware is placed on the cooking plate. The cooking apparatus may compare the capacitance with a plurality of preset thresholds to accurately determine whether the cookware is placed on the cooking plate and simultaneously, increase energy efficiency.

For example, the cooking apparatus may determine whether to perform a process of re-determining whether the cookware is placed on the cooking plate based on whether the capacitance value exceeds the preset first threshold or exceeds both the first threshold and second threshold.

If the capacitance value exceeds only the first threshold, the cooking apparatus may perform the process of re-determining whether the cookware is placed on the cooking plate. In an embodiment, the cooking apparatus may apply a driving current to an induction heating coil corresponding to an area determined to have the cookware placed therein and measure a change in state of the induction heating coil to re-determine whether the cookware is placed on the cooking plate. In this regard, the cooking apparatus may identify the induction heating coil corresponding to the area determined to have the cookware herein, based on at least one of a preset switching sequence and the identification information according to the form of connection between the electrode pair and the capacitance detection circuit.

Even while the re-determination process is being performed, another cookware may be placed on the cooking plate. Accordingly, the cooking apparatus may continue to detect capacitance to determine whether the other cookware is placed on the cooking plate and identify an induction heating coil corresponding to the position of the other cookware, even while performing the re-determination process. In other words, the cooking apparatus may provide quick service for the user by performing the re-determination process and the capacitance-based process to determine where the cookware is placed in parallel.

If the capacitance value exceeds both the first and second thresholds, the cooking apparatus may fixedly determine that the cookware is placed on the cooking plate and may not perform the re-determination process. In this regard, the cooking apparatus may identify the induction heating coil corresponding to the area determined to have the cookware herein, based on at least one of a preset switching sequence and the identification information according to the form of connection between the electrode pair and the capacitance detection circuit.

Figure 27:
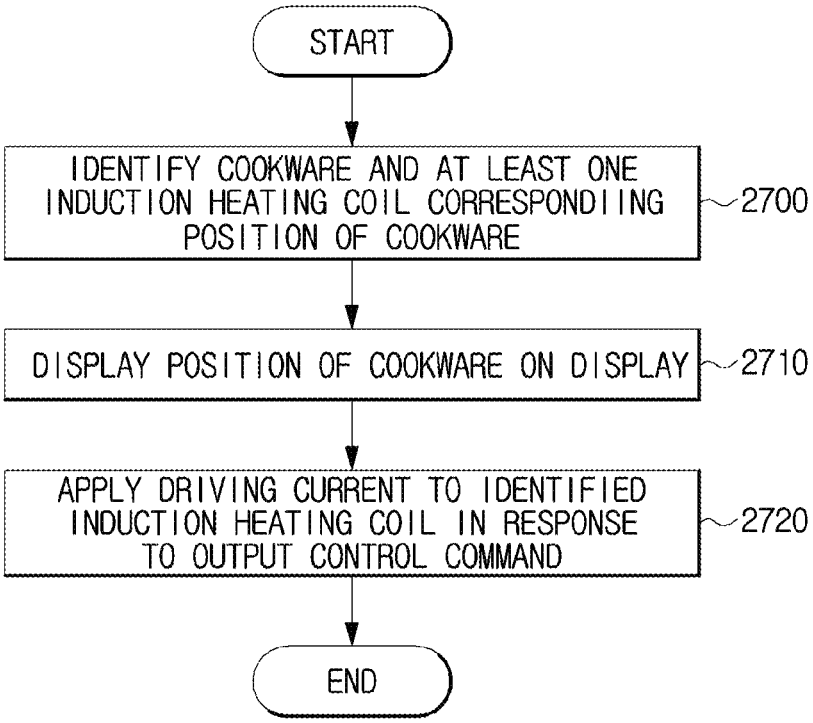
FIG. 27 illustrates a flowchart schematically of an operation of a cooking apparatus for providing a result of determination of a position of the cookware, according to an embodiment of the present disclosure.

FIG. 27 illustrates a flowchart schematically of an operation of a cooking apparatus for providing a result of determination of a position of the cookware, according to an embodiment of the present disclosure.

The cookware identifies a position of the cookware and at least one induction heating coil corresponding to the cookware based on the capacitance detected by using the electrodes arranged on one side of each of the plurality of induction heating coils, in 2700. How to identify the position of the cookware and at least one induction heating coil corresponding to the cookware is described above, so the description thereof will not be repeated.

The cooking apparatus displays the position of the cookware on the display, in 2710. The cooking apparatus allows the user to determine the position of the cookware by displaying the position of the cookware on the display.

The cooking apparatus applies a driving current to an identified induction heating coil in response to an output control command, in 2720. The cooking apparatus may receive the output control command in various ways. For example, the cooking apparatus may receive the output control command through the display or through the input button, without being limited thereto.

The cooking apparatus may apply a driving current to the identified induction heating coil to correspond to an output level according to the output control command. For example, as described above, there may be a plurality of driving assemblies separately installed in the cooking apparatus. In an embodiment, one of the first to fourth driving assemblies 1031, 1032, 1033, 1034 of the cooking apparatus may apply the driving current to the identified induction heating coil.

Embodiments and features as described and illustrated in the present disclosure are only preferred examples, and various modifications thereof may also fall within the scope of the disclosure.

The terminology used herein is for the purpose of describing particular embodiments only and is not intended to limit the present disclosure. It is to be understood that the singular forms "a," "an," and "the" include plural references unless the context clearly dictates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or section discussed below could be termed a second element, component, region, layer or section without departing from the teachings of the present disclosure. Descriptions shall be understood as to include any and all combinations of one or more of the associated listed items when the items are described by using the conjunctive term "~ and/or ~," or the like.

Furthermore, the terms as used throughout the specification, such as "~ part", "~ block", "~ member", "~ module", etc., may mean a unit of handling at least one function or operation. For example, it may refer to software or hardware, such as field programmable gate arrays (FPGAs) or application specific integrated circuits (ASICs). However, the terms "~ part", "~ block", "~ member", "~ module", etc., are not limited to software or hardware, but may be any element to be stored in an accessible storage medium and processed by one or more processors.

According to embodiments of the present disclosure, a cooking apparatus may be able to make more accurate decision on whether the cookware is placed on the cooking plate with low power.

According to embodiments of the present disclosure, a cooking apparatus may be able to identify at least one induction heating coil corresponding to a position of the cookware when it is determined that the cookware is placed on the cooking plate.

Although the present disclosure has been described with various embodiments, various changes and modifications may be suggested to one skilled in the art. It is intended that the present disclosure encompass such changes and modifications as fall within the scope of the appended claims.

What is claimed is:

1. A cooking apparatus comprising:

a capacitance detector configured to detect capacitance using two or more electrodes arranged on one side of each of a plurality of induction heating coils; and a cookware detection controller configured to:

determine whether cookware is placed over an induction heating coil based on whether the detected capacitance exceeds a preset first threshold, and identify the induction heating coil corresponding to a position where the cookware is placed among the plurality of induction heating coils based on a location of the two or more electrodes used to detect the capacitance, wherein the cookware detection controller is configured to:

when the detected capacitance exceeds both the preset first threshold and a preset second threshold, identify that the induction heating coil on which the two or more electrodes used to detect the capacitance are arranged is corresponding to the position where the cookware is placed, and when the detected capacitance exceeds the preset first threshold and is less than the preset second threshold, perform a re-determination process that controls a driving current to be applied to the induction heating coil on which the two or more electrodes used to detect the capacitance are arranged.

2. The cooking apparatus of claim 1, wherein:

each of the plurality of induction heating coils includes a first electrode and a second electrode implemented in a form of at least one symbol, polygon, letter, or number on the one side, and the capacitance detector is configured to detect capacitance from a potential difference between the first electrode and the second electrode.

3. The cooking apparatus of claim 1, wherein a ratio between a total area of the two or more electrodes and an area of the induction heating coil with the two or more electrodes arranged on the one side is predetermined.

4. The cooking apparatus of claim 1, wherein the two or more electrodes are:

inserted and fixed between the plurality of induction heating coils and a cooking plate, or attached onto a base that receives at least one of the plurality of induction heating coils by an adhesive material durable under at least a predetermined temperature.

5. The cooking apparatus of claim 1, wherein:

each of the plurality of induction heating coils includes an insulation sheet provided on the one side, and the two or more electrodes are attached onto one face of the insulation sheet by an adhesive material.

6. The cooking apparatus of claim 1, wherein the capacitance detector is configured to detect capacitance using the two or more electrodes arranged on top of each of the plurality of induction heating coils.

7. The cooking apparatus of claim 1, wherein the cookware detection controller is configured to, when the detected capacitance exceeds the preset first threshold and is less than the preset second threshold perform the re-determination process that re-determines whether the induction heating coil corresponds to the position where the cookware is placed based on at least one of a magnitude and a phase of a current in the induction heating coil to which the driving current is applied.

8. The cooking apparatus of claim 1, wherein the cookware detection controller is configured to re-detect capacitance and perform the re-determination process when the detected capacitance exceeds the preset first threshold and is less than the preset second threshold.

9. The cooking apparatus of claim 1, wherein the cookware detection controller is configured to display information about at least one of the identified induction heating coil and the position where the cookware is placed on a display.

10. The cooking apparatus of claim 1, wherein at least two or more electrodes arranged on a side of each of the plurality of induction heating coils are individually connected to an electrode connection terminal that supports connection with the capacitance detector or grouped to be connected to the electrode connection terminal.

11. A cooking apparatus comprising:

a cookware detection assembly configured to:

detect capacitance by two or more electrodes arranged on one side of each of a plurality of induction heating coils, determine whether cookware is placed over an induction heating coil based on whether the detected capacitance exceeds a preset first threshold, and identify at least one induction heating coil corresponding to a position where the cookware is placed among the plurality of induction heating coils based on a location of the two or more electrodes used to detect the capacitance; and a main assembly configured to control components in the cooking apparatus based on data about the position where the cookware is placed and data about the at least one identified induction heating coil received from the cookware detection assembly wherein the cookware detection assembly is configured to:

when the detected capacitance exceeds both the preset first threshold and a preset second threshold, identify that the induction heating coil on which the two or more electrodes used to detect the capacitance are arranged is corresponding to the position where the cookware is placed, and when the detected capacitance exceeds the preset first threshold and is less than the preset second threshold, perform a re-determination process that controls a driving current to be applied to the induction heating coil on which the two or more electrodes used to detect the capacitance are arranged.

12. The cooking apparatus of claim 11, wherein the main assembly is configured to control a position where the cookware is placed to be displayed on a display.

13. The cooking apparatus of claim 11, wherein:

each of the plurality of induction heating coils includes a first electrode and a second electrode arranged on the one side, and the cookware detection assembly is configured to detect capacitance from a potential difference between the first electrode and the second electrode.

14. The cooking apparatus of claim 11, wherein a ratio between a total area of the two or more electrodes and an area of an induction heating coil with the two or more electrodes arranged on the one side is predetermined.

15. The cooking apparatus of claim 11, wherein the cookware detection assembly is configured to, when the detected capacitance exceeds the preset first threshold and is less than the preset second threshold perform the re-determination process that re-determines whether the induction heating coil corresponds to the position where the cookware is placed based on at least one of a magnitude and a phase of a current in the at least one induction heating coil to which the driving current is applied.

16. The cooking apparatus of claim 11, wherein the cookware detection assembly is configured to, when the two or more electrodes are grouped to be connected to an electrode connection terminal, control switching devices in a predetermined switching sequence based on a form that the two or more electrodes are grouped, to sequentially detect capacitance.

* * * * *